US009933170B2

(12) United States Patent
Wong

(10) Patent No.: US 9,933,170 B2
(45) Date of Patent: Apr. 3, 2018

(54) WATER-COOLED SPLIT AIR CONDITIONING SYSTEM

(71) Applicant: Lee Wa Wong, Pico Rivera, CA (US)

(72) Inventor: Lee Wa Wong, Pico Rivera, CA (US)

( * ) Notice: Subject to any disclaimer, the term of this patent is extended or adjusted under 35 U.S.C. 154(b) by 631 days.

(21) Appl. No.: 14/456,854

(22) Filed: Aug. 11, 2014

(65) Prior Publication Data

US 2016/0040895 A1 Feb. 11, 2016

(51) Int. Cl.

| | |
|---|---|
| ***F24F 3/00*** | (2006.01) |
| ***F24F 3/06*** | (2006.01) |
| ***F24F 1/00*** | (2011.01) |
| ***F24F 1/42*** | (2011.01) |

(52) U.S. Cl.

CPC ..... *F24F 3/06* (2013.01); *F24F 1/0003* (2013.01); *F24F 1/42* (2013.01)

(58) Field of Classification Search

CPC ..... F24F 1/0003; F24F 1/0007; F24F 1/42; F24F 2001/0096; F24F 2001/0074; F24F 3/06; F24F 3/10; F24F 3/14; F24F 3/153; F24F 2003/1435; F24F 5/0035; F24F 2006/046; F24F 2203/1056; F28C 1/14; F28D 1/05325

See application file for complete search history.

(56) References Cited

U.S. PATENT DOCUMENTS 2,493,141 A * 1/1950 Henney ..... B61D 27/0072 62/120
2,590,779 A * 3/1952 Lehmann ..... F28F 25/04 239/43
3,030,226 A 4/1962 Heaton et al.
3,747,362 A * 7/1973 Mercer ..... F24F 3/14 62/121
3,864,442 A * 2/1975 Percy ..... F28C 1/14 165/160
4,182,131 A * 1/1980 Marshall ..... F24F 5/001 62/305
4,615,182 A * 10/1986 Worthington ..... F24F 5/0035 261/19
6,595,011 B1 * 7/2003 Forgy ..... F24F 5/0035 62/305
2007/0000274 A1 1/2007 Li
(Continued)

FOREIGN PATENT DOCUMENTS

EP 1801520 A1 6/2007

*Primary Examiner* — Travis Ruby
(74) *Attorney, Agent, or Firm* — Tsz Lung Yeung

(57) ABSTRACT

A water-cooled split air conditioning system includes an indoor unit, an outdoor unit, and a plurality of connecting hoses. The outdoor unit includes an outdoor housing and a water cooling unit. The water cooling unit includes a pumping device, a top water collection basin, a fill material unit provided underneath the top water collection basin, a bottom water collection basin provided underneath the fill material unit, and a plurality of heat exchanging pipes provided in the bottom water collection basin and immersed in the cooling water. The cooling water collected in the bottom water collection tank is arranged to be guided to flow back into the top water collection basin. A predetermined amount of refrigerant is arranged to flow through the heat exchanging pipes to perform highly efficient heat exchanging process with the cooling water for lowering a temperature of the refrigerant.

31 Claims, 24 Drawing Sheets

(56) References Cited

U.S. PATENT DOCUMENTS

| | | | | |
|---|---|---|---|---|
| 2008/0006039 | A1* | 1/2008 | Kim | F04D 17/06 62/93 |
| 2008/0087030 | A1 | 4/2008 | Park et al. | |
| 2009/0013715 | A1* | 1/2009 | Setoguchi | F24F 1/0007 62/524 |
| 2011/0023533 | A1 | 2/2011 | Shimazu | |
| 2013/0167559 | A1 | 7/2013 | Kim et al. | |
| 2013/0276476 | A1 | 10/2013 | Wong | |
| 2014/0138859 | A1 | 5/2014 | Daley et al. | |

* cited by examiner

WATER-COOLED SPLIT AIR CONDITIONING SYSTEM

BACKGROUND OF THE PRESENT INVENTION

Field of Invention

The present invention relates to an air conditioning system, and more particularly to a water-cooled split-type air conditioning system comprising a water cooling unit which utilizes water as a cooling agent.

Description of Related Arts

Referring to FIG. 1 to FIG. 3 of the drawings, a conventional air-cooled split air conditioning system is illustrated. The air-cooled split air conditioning system comprises an outdoor unit 100P and two indoor units 200P. The outdoor unit 100P usually comprises a compressor 101P, a power device 105P, a heat exchanging coil 102P, and an air cooling unit 103P accommodated in a housing 104P. The housing 104P has a refrigerant inlet 1041P and a refrigerant outlet 1042P. Refrigerant in vaporous or steam state is pumped into the heat exchanging coil 102P through the refrigerant inlet 1041P. The air cooling unit 103P which is usually embodied as a fan draws ambient air into the housing 104P. The ambient air drawn into the housing 104P is arranged to perform heat exchange with the refrigerant in the heat exchanging coil 102P and extract heat from the refrigerant. The air having absorbed heat from the refrigerant is then expelled out of the housing 104P. At the same time, the refrigerant converts into liquid state and is arranged to leave the outdoor unit 100P through the refrigerant outlet 1042P. The outdoor unit 100P and the indoor unit 200P are connected by a first and a second refrigerant hose 300P.

The refrigerant coming from the outdoor unit 100P is guided to flow, usually through a dryer filter 301P and an expansion valve 400P, into an evaporator unit 201P located in each of the indoor units 200P. The refrigerant absorbs heat from the space in which the corresponding indoor unit 200P is located (referred to as indoor space hereinafter).

Referring to FIG. 4 to FIG. 6 of the drawings, a conventional air-cooled split heat pump system is illustrated. The conventional air-cooled split heat pump system is structurally similar to the above-mentioned air-cooled split air conditioning system except that the conventional air-cooled split heat pump system further comprises a four-way valve 5012P provided in the outdoor unit. Thus, the conventional air-cooled split heat pump system comprises an outdoor unit 501P, and two indoor units 502P. The outdoor unit 501P comprises an outdoor housing 5014P, a compressor unit 5011P, a four-way valve 5012P, an outdoor heat exchanging unit 5013P, an air cooling unit 5015P, and a power device 5016P. The indoor unit 502P comprises an indoor heat exchanging unit 5021P, a plurality of filters 5022P, a plurality of expansion valves 5023P, and a plurality of unidirectional valves 5024P.

The conventional air-cooled split heat pump system may be selectively used as an air conditioner for producing cool air within the indoor space. Alternatively, it may act as a heat pump for delivering heated air in that predetermined indoor space.

Referring to FIG. 6 of the drawings, it illustrates a refrigerant cycle of the conventional air-cooled split heat pump system. The four-way valve 5012P has first through fourth connecting ports 1P, 2P, 3P, 4P. When the conventional air-cooled split heat pump system acts as an air conditioner, the first connecting port 1P of the four-way valve 5012P is connected to the compressor unit 5011P and the second connecting port 2P which is connected to the outdoor heat exchanging unit 5013P. The third connecting port 3P of the four way valve 5012P is connected to the fourth connecting port 4P, which is connected to the indoor heat exchanging unit 5021P. The refrigerant sequentially flows through the compressor unit 5011P, the first connecting port 1P, the second connecting port 2P, the outdoor heat exchanging unit 5013P, the unidirectional valve 5024P, the filter 5022P, the expansion valve 5023P, the indoor heat exchanging unit 5021P, and finally back to the compressor unit 5011P.

When the conventional air-cooled split heat pump system acts as a heat pump, the first connecting port 1P is connected to the compressor unit 5011P and the fourth connecting 4P, which is connected to the indoor heat exchanging unit 5021P. On the other hand, the second connecting port 2P, which is connected to the outdoor heat exchanging unit 5013P, is connected to the third connecting port 3P which is connected to the compressor unit 5011P. The refrigerant sequentially flows through the compressor unit 5011P, the first connecting port 1P, the fourth connecting port 4P, the indoor heat exchanging unit 5021P, the one-way valve 5024P, the filter 5022P, the expansion valve 5023P, the outdoor heat exchanging unit 5013P, and finally back to the compressor unit 5011P.

The above-mentioned air-cooled split air conditioning system and air-cooled split heat pump system have a common disadvantage of having a relatively low coefficient of performance (C.O.P) which is the efficiency ratio of the amount of heating or cooling provided by the respective heating or cooling unit. For the above mentioned systems, the C.O.P is approximately 3.2. This is unsatisfactory in view of rapidly increasing energy demand throughout the world.

SUMMARY OF THE PRESENT INVENTION

An objective of the present invention is to provide a water-cooled split air conditioning system which has an enhanced Coefficient of Performance (C.O.P.) as compared to conventional air-cooled split air conditioning systems or conventional air-cooled split heat pump systems.

Another objective of the present invention is to provide a water-cooled split air conditioning system which utilizes water as a cooling agent for cooling the refrigerant circulating around the entire system. The advantage of doing so is to increase the C.O.P. of the entire system.

Another objective of the present invention is to provide a water-cooled split air conditioning system which can be embodied as an air conditioner or as a heat pump. The water cooling unit can be selectively used for cooling the refrigerant circulating in the water-cooled split air conditioning system.

In one aspect of the present invention, it provides a water-cooled split air conditioning system, comprising:

an indoor unit comprising an indoor heat exchanging unit;

an outdoor unit, which comprises:

an outdoor housing having an air inlet, an air outlet, and a water tank for storing a predetermined amount of cooling water; and a water cooling unit, which comprises:

a pumping device provided in the water tank for pumping the cooling water;

a top water collection basin for collecting the cooling water from the pumping device;

a fill material unit provided underneath the top water collection basin, wherein the cooling water collected in the top water collection basin is arranged to flow through the fill material unit;

a bottom water collection basin provided underneath the fill material unit, the cooling water from the fill material unit being arranged to be collected in the bottom water collection basin; and at least one heat exchanging pipe provided in the bottom water collection basin and immersed in the cooling water, the cooling water collected in the bottom water collection tank being arranged to be guided to flow back into the top water collection basin, a predetermined amount of refrigerant being arranged to flow through the heat exchanging pipe in such a manner that the refrigerant is arranged to perform highly efficient heat exchanging process with the cooling water for lowering a temperature of the refrigerant, a predetermined amount of air being drawn from the air inlet for performing heat exchange with the cooling water flowing through the fill material unit for lowering a temperature of the cooling water, the air having absorbed the heat from the cooling water being discharged out of the indoor housing through the air outlet; and a plurality of connecting hoses connecting the indoor unit to the outdoor unit for allowing the refrigerant to circulate between the indoor unit and the outdoor unit.

DETAILED DESCRIPTION OF THE PREFERRED EMBODIMENT

The following detailed description of the preferred embodiments are the preferred modes of carrying out the invention. The description is not to be taken in any limiting sense. It is presented for the purpose of illustrating the general principles of the present invention.

Figure 1:
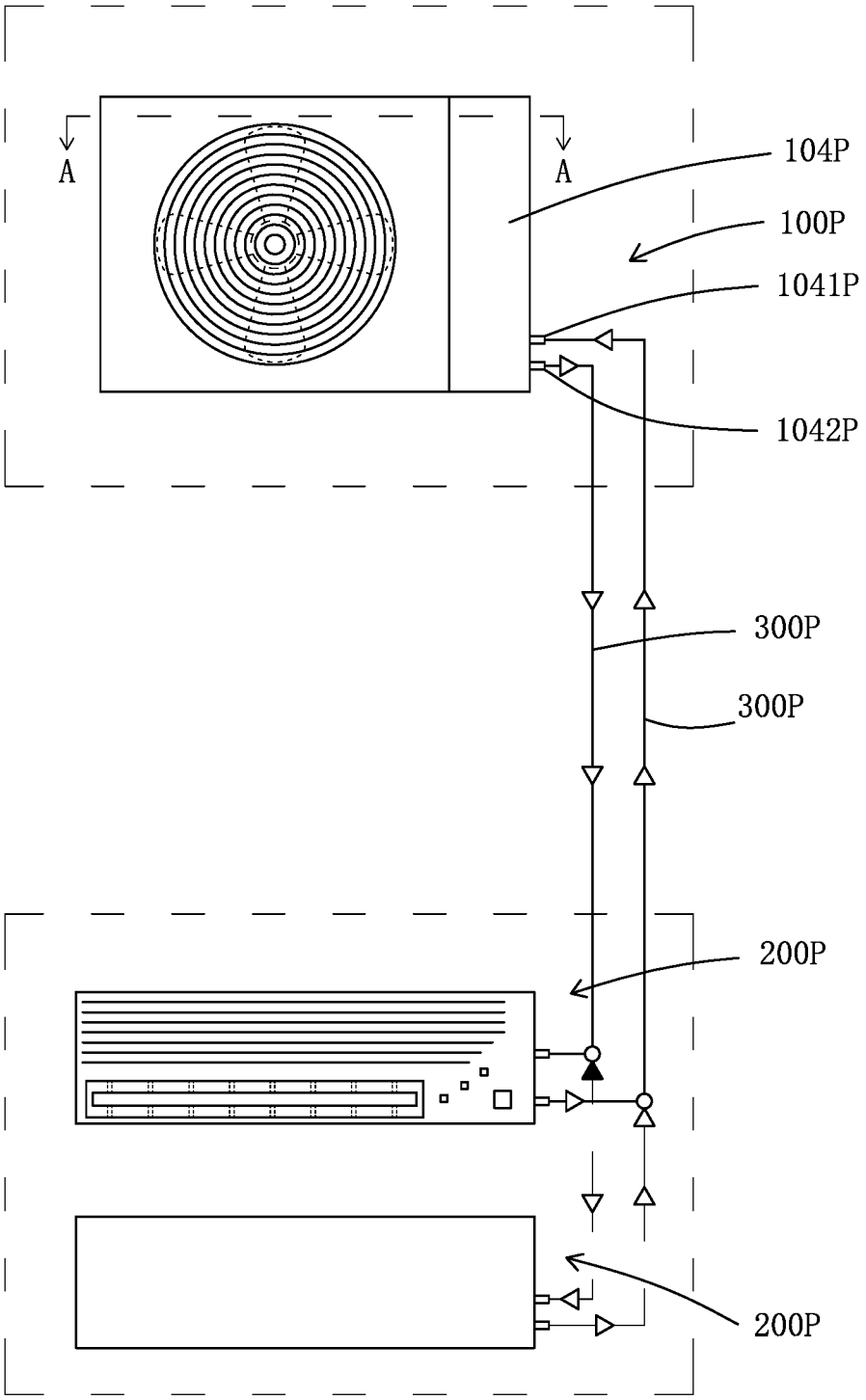
FIG. 1 PRIOR ART
FIG. 1 is a conventional air-cooled split air conditioning system.
Figure 2:
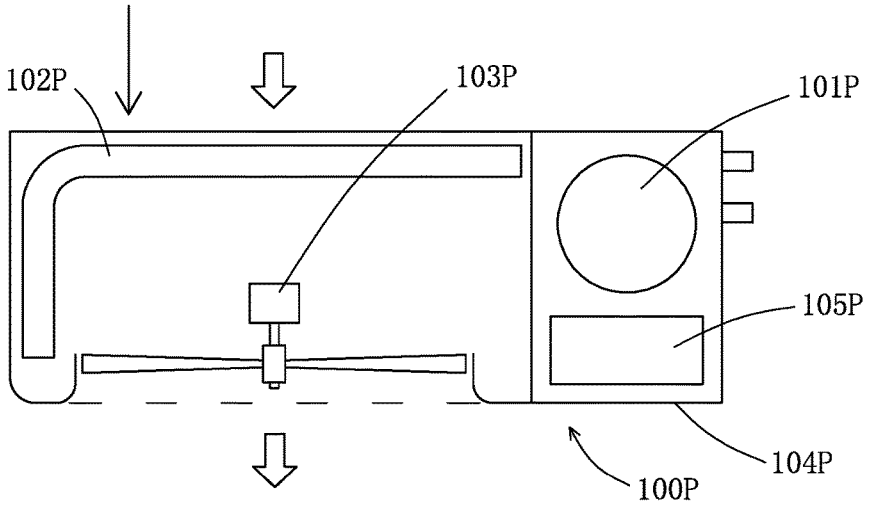
FIG. 2 PRIOR ART
FIG. 2 is a sectional view of the conventional air-cooled split air conditioning system along plane A-A of FIG. 1.
Figure 3:
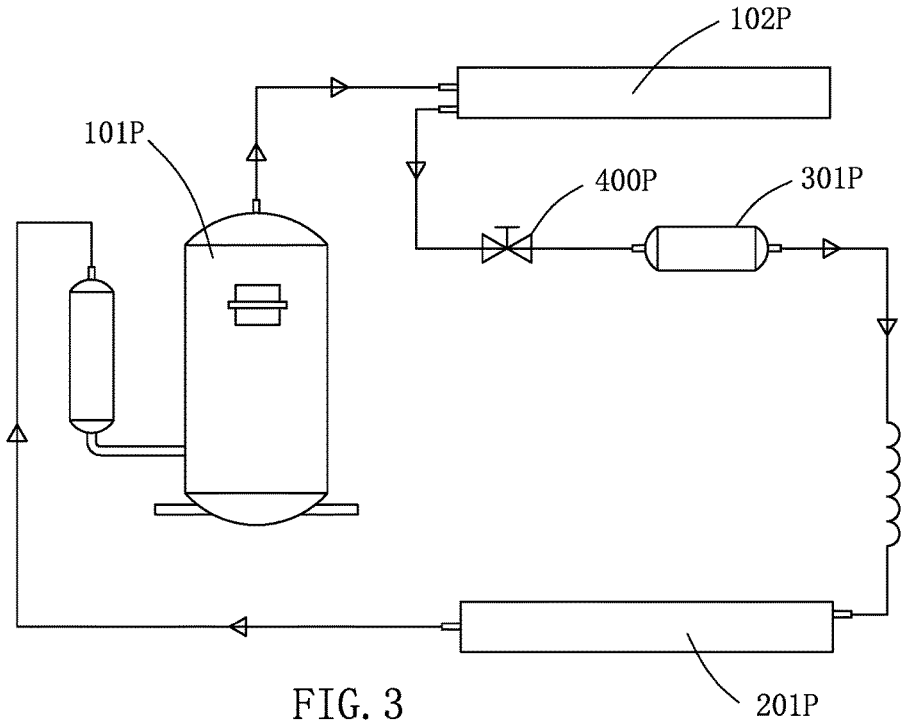
FIG. 3 PRIOR ART
FIG. 3 is a schematic diagram of a refrigerant cycle of the conventional air-cooled split air conditioning system.
Figure 4:
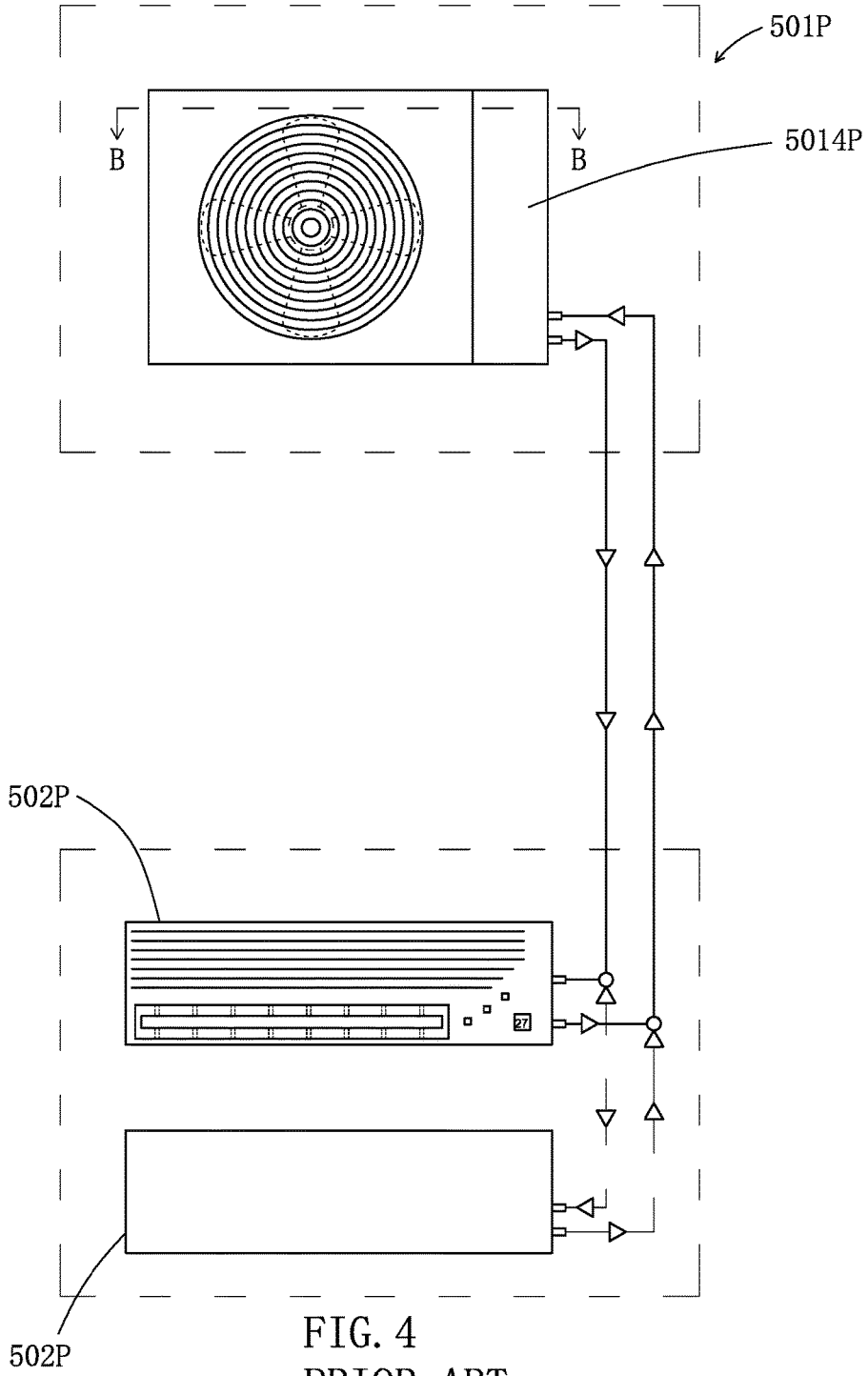
FIG. 4 PRIOR ART
FIG. 4 is a conventional air-cooled split heat pump system.
Figure 5:
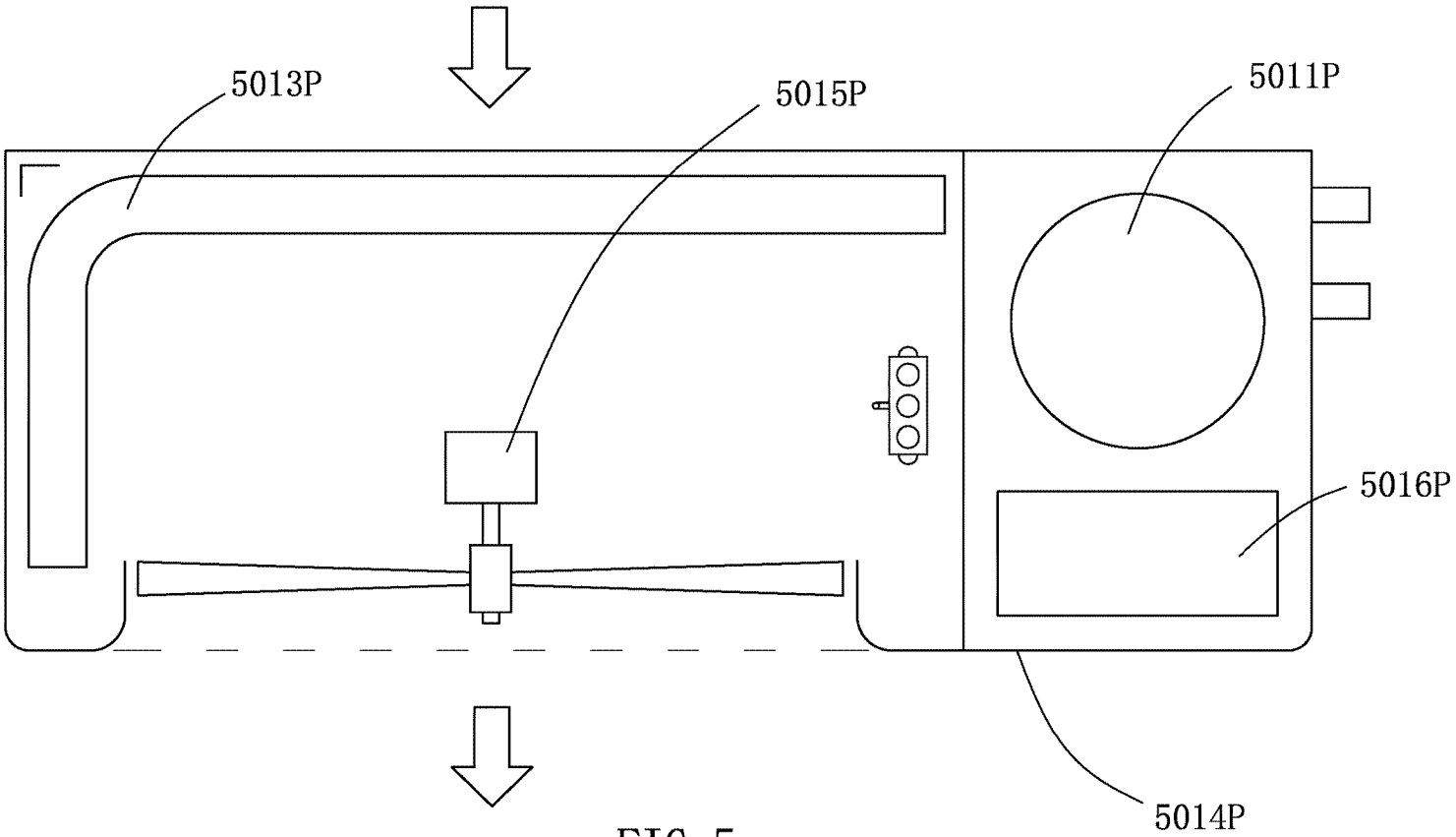
FIG. 5 PRIOR ART
FIG. 5 is a sectional side view of the conventional air-cooled split heat pump system along plane B-B of FIG. 4.
Figure 6:
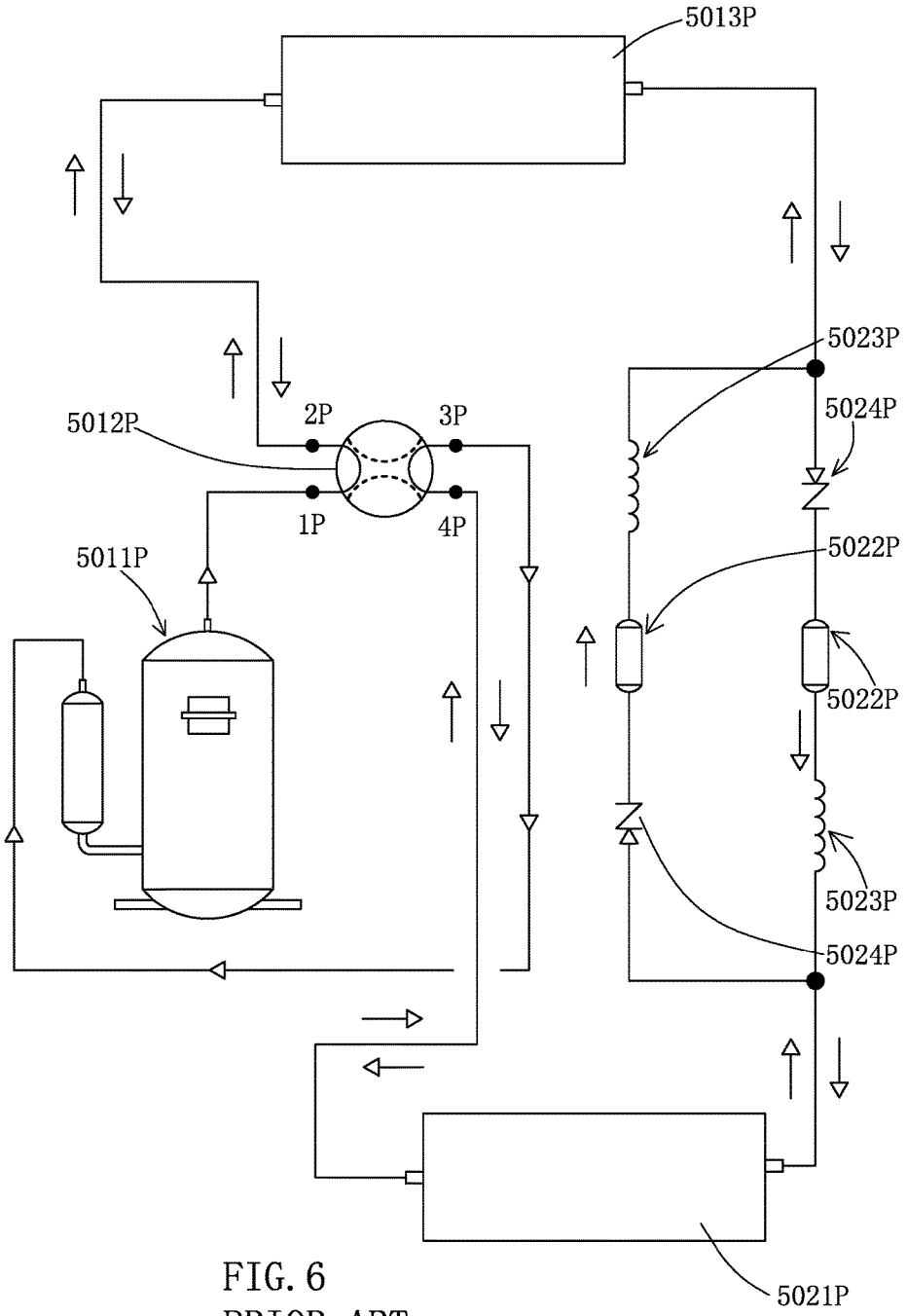
FIG. 6 PRIOR ART
FIG. 6 is a schematic diagram of a refrigerant cycle of the conventional air-cooled split heat pump system.
Figure 7:
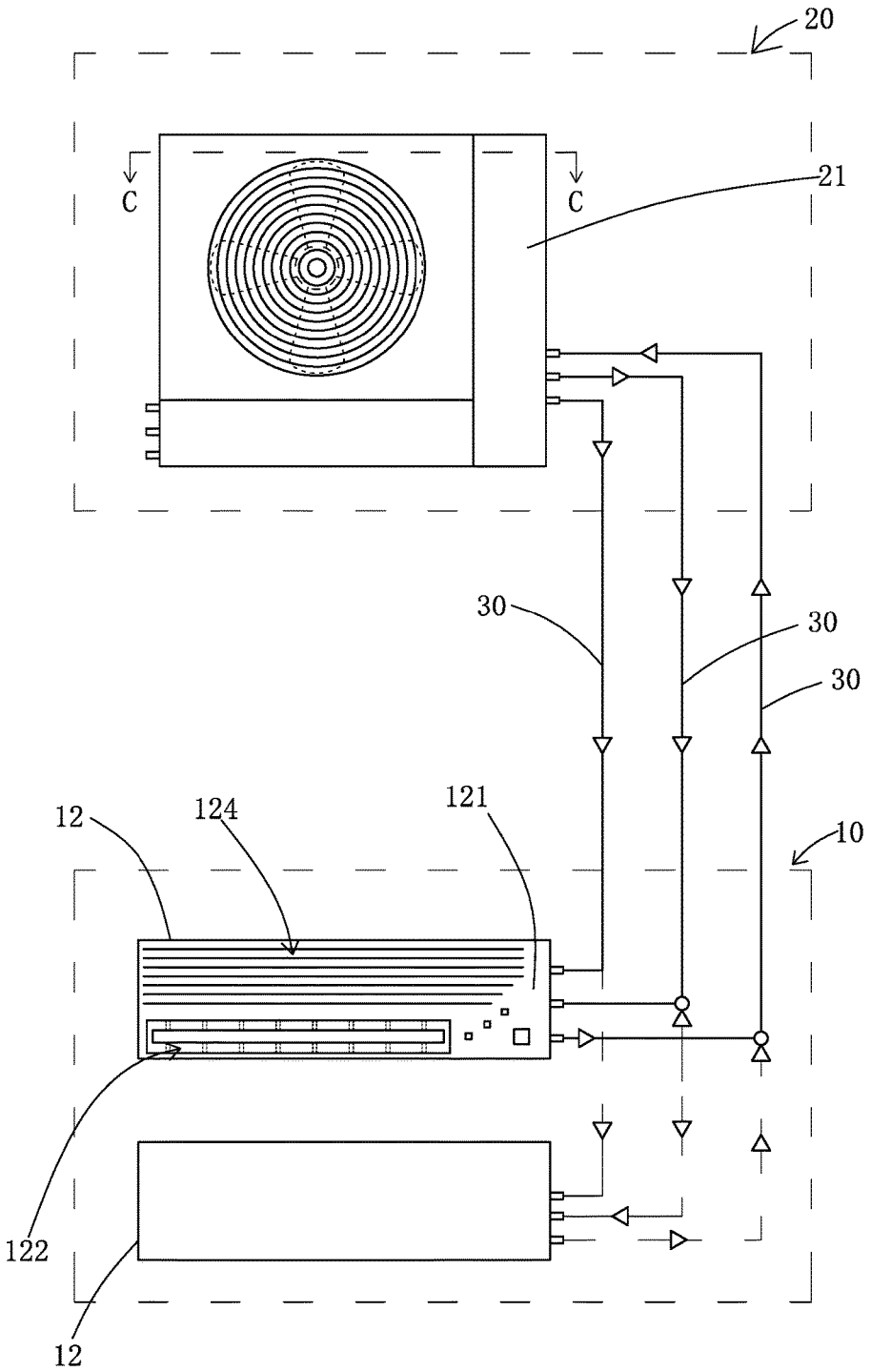
FIG. 7 is a schematic diagram of a water-cooled split air conditioning system according to a first preferred embodiment of the present invention.
Figure 8:
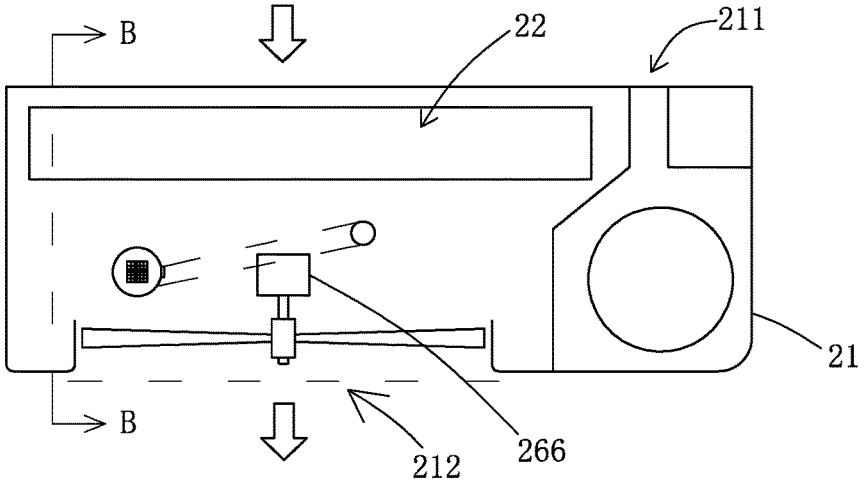
FIG. 8 is a sectional view of the water-cooled split air conditioning system along plane C-C of FIG. 7.
Figure 9:
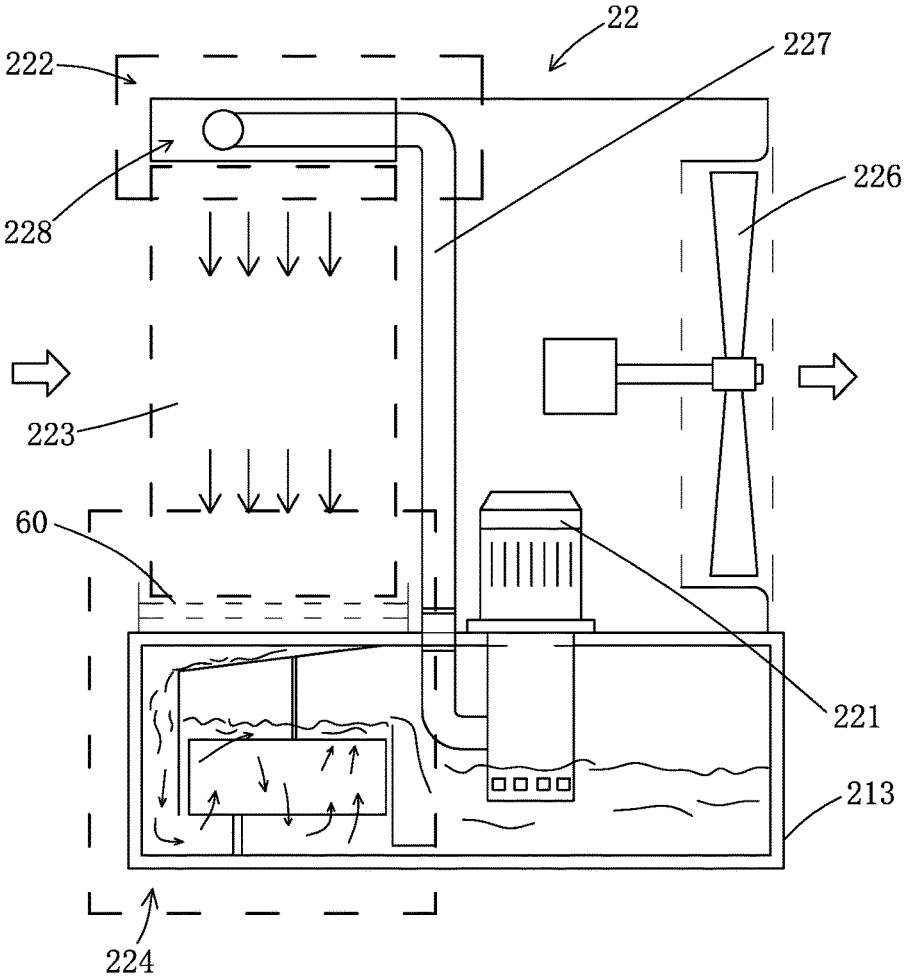
FIG. 9 is a sectional side view of an outdoor unit of the water-cooled split air conditioning system according to a first preferred embodiment of the present invention.

Referring to FIG. 7 to FIG. 9 of the drawings, a water-cooled split air conditioning system according to a first preferred embodiment of the present invention is illustrated. Broadly, the water-cooled split air conditioning system comprises an indoor unit 10 comprising an indoor heat exchanging unit 11, an outdoor unit 20, and a plurality of connecting hoses 30. The water-cooled split air conditioning system utilizes a predetermined amount of working fluid, such as a predetermined amount of refrigerant, for carrying out heat exchange in various components of the system.

The outdoor unit 20 comprises an outdoor housing 21 and a water cooling unit 22. The water cooling unit 22 comprises a pumping device 221, a top water collection basin 222, a fill material unit 223, a bottom water collection basin 224, and a plurality of heat exchanging pipes 225.

The outdoor housing 21 has an air inlet 211, an air outlet 212, and a water tank 213 for storing a predetermined amount of cooling water. The pumping device 221 is provided in the water tank 213 for pumping the cooling water from the water tank 213 to the top water collection basin 222, which is arranged to collect the cooling water from the pumping device 221.

The fill material unit 223 is provided underneath the top water collection basin 224, wherein the cooling water collected in the top water collection basin 222 is arranged to flow through the fill material unit 223.

The bottom water collection basin 224 is provided underneath the fill material unit 223. The cooling water coming from the fill material unit 223 is arranged to be collected in the bottom water collection basin 224 after passing through a filter 60.

The heat exchanging pipes 225 are provided in the bottom water collection basin 224 and are arranged to immerse in the cooling water. The cooling water collected in the bottom water collection tank 224 is arranged to be guided to flow back to the top water collection basin 222. At the same time, a predetermined amount of refrigerant is arranged to flow through the heat exchanging pipes 225 in such a manner that the refrigerant is arranged to perform highly efficient heat exchanging process with the cooling water for lowering a temperature of the refrigerant. Furthermore, a predetermined amount of air is drawn from the air inlet 211 for performing heat exchange with the cooling water flowing through the fill material unit 223 for lowering a temperature of the cooling water. The air having absorbed the heat from the cooling water is discharged out of the indoor housing 21 through the air outlet 213.

The connecting hoses 30 connect the indoor unit 10 to the outdoor unit 20 for allowing the refrigerant to circulate between the indoor unit 10 and the outdoor unit 20.

According to the first preferred embodiment of the present invention, the indoor unit 10 is arranged to simultaneously connect to two identical indoor fan coil units 12 of the outdoor unit 10. As shown in FIG. 7 of the drawings, a single outdoor unit 20 is connected to two indoor fan coil units 12 each having the indoor heat exchanging unit 11. Furthermore, there are at least three connecting hoses 30 connecting the two indoor fan coil units 12 to the outdoor unit 20.

As shown in FIG. 8 to FIG. 9 of the drawings, the outdoor unit 20 further comprises a fan unit 226 provided in the outdoor housing 21 for drawing ambient air to flow between the air inlet 211 and the air outlet 212. Thus, the fan unit 226 is positioned at one side of the fill material unit 223 for drawing ambient air to flow along a transverse direction of the fill material unit 223.

The water tank 213 and the bottom water collection basin 224 are positioned in a side-by-side manner. The cooling water collected in the bottom water collection basin 224 is guided to flow into the water tank 213, which is then pumped back to the top water collection basin 222 by the pumping device 221 via a water tube 227.

Figure 10:
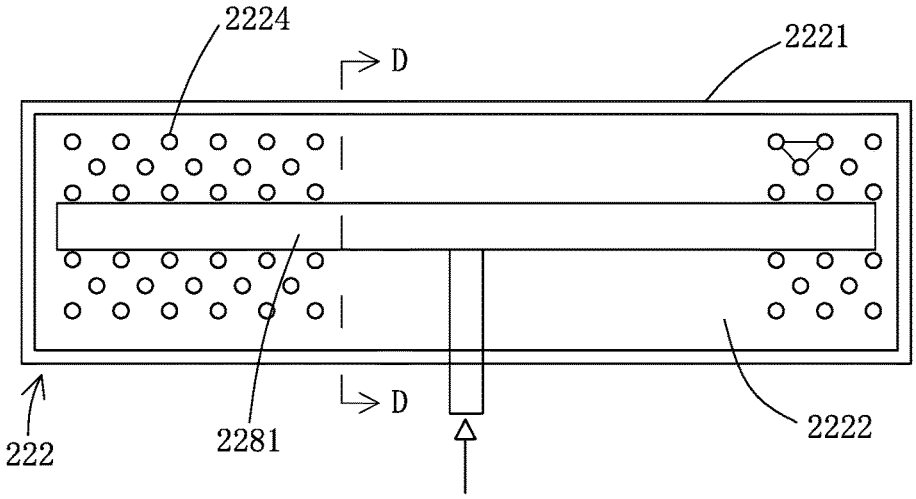
FIG. 10 is a plan view of a top water collection basin of the water-cooled split air conditioning system according to a first preferred embodiment of the present invention.
Figure 11:
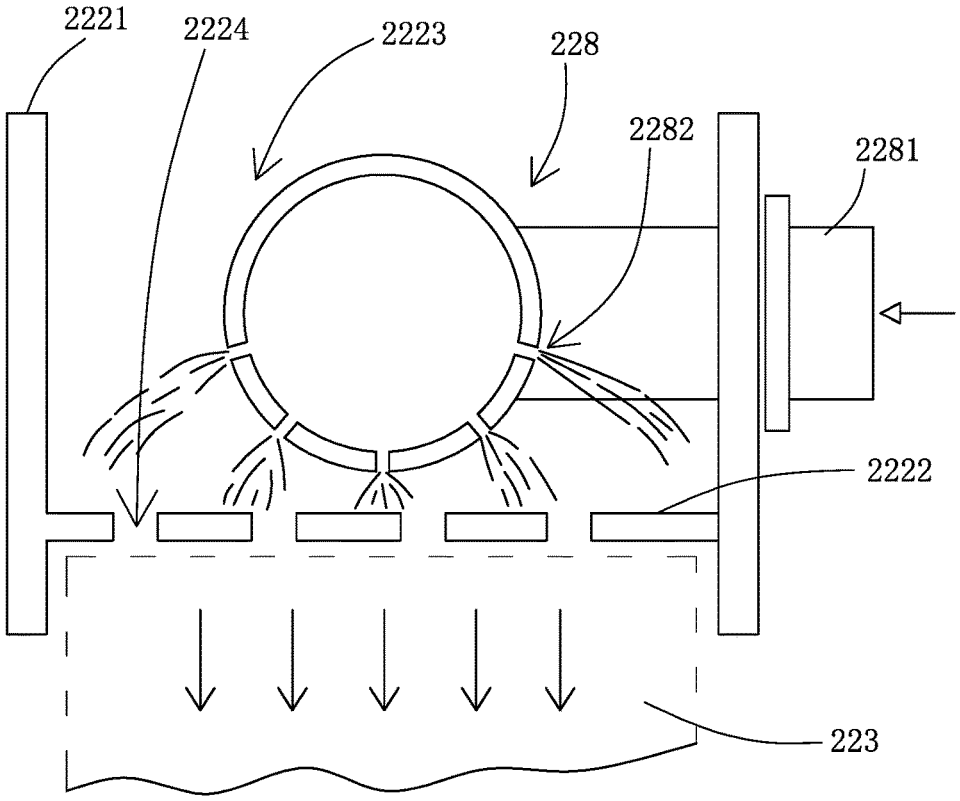
FIG. 11 is a section side view of the top water collection basin along plane D-D of FIG. 10.

Referring to FIG. 10 to FIG. 11 of the drawings, the top water collection basin 222 has at least one peripheral sidewall 2221 and a bottom wall 2222 to define a storing cavity 2223 between the peripheral sidewall 2221 and the bottom wall 2222. The cooling water coming from the water tank 213 is arranged to be stored in the storing cavity 2223. The bottom wall 2222 has a plurality of passage holes 2224, wherein the cooling water stored in the storing cavity 2223 may flow onto the fill material unit 223 through the passage holes 2224.

Furthermore, the passage holes 2224 are distributed along the bottom wall 2222 in a predetermined array, wherein a center of each of the passage holes 2224 in a particular row is arranged not to align with that of the passage holes 2224 in the next row. Moreover, each two adjacent passage holes 2224 of an upper row thereof is arranged to form a triangular distribution with a corresponding passage hole 2224 of the adjacent row of the passage holes 2224, as shown in FIG. 10 of the drawings. All of the passage holes 2224 have an identical shape and size.

The water cooling unit 22 further comprises a water distributor 228 provided on a top end portion of the water tube 227 for distributing the cooling water into the storing cavity 2223 of the top water collection basin 222. Specifically, the water distributor 228 comprises a distributor tube 2281 longitudinally extended along a longitudinal direction of the top water collection basin 222, and a plurality of distributing slots 2282 formed on the distributor tube 2281. The cooling water flowing in the water tube 227 is allowed to flow into the distributor tube 2281 and then into the storing cavity 2223 via the distributing slots 2282. The distributor tube 2281 has a substantially circular cross section. The distributing slots 2282 are evenly formed on a lower circular portion of the distributor tube 2281 so that the cooling water can be evenly spread on the bottom wall 2222 of the top water collection basin 222. The evenly distributed cooling water in the storing cavity 2223 is then allowed to flow onto the fill material unit 223 via the evenly distributed passage holes 2224 as shown in FIG. 11 of the drawings. These structures ensure that a water thin film can be evenly formed in the fill material unit 223 as the cooling water flows downwardly along the fill material unit 223.

Figure 12:
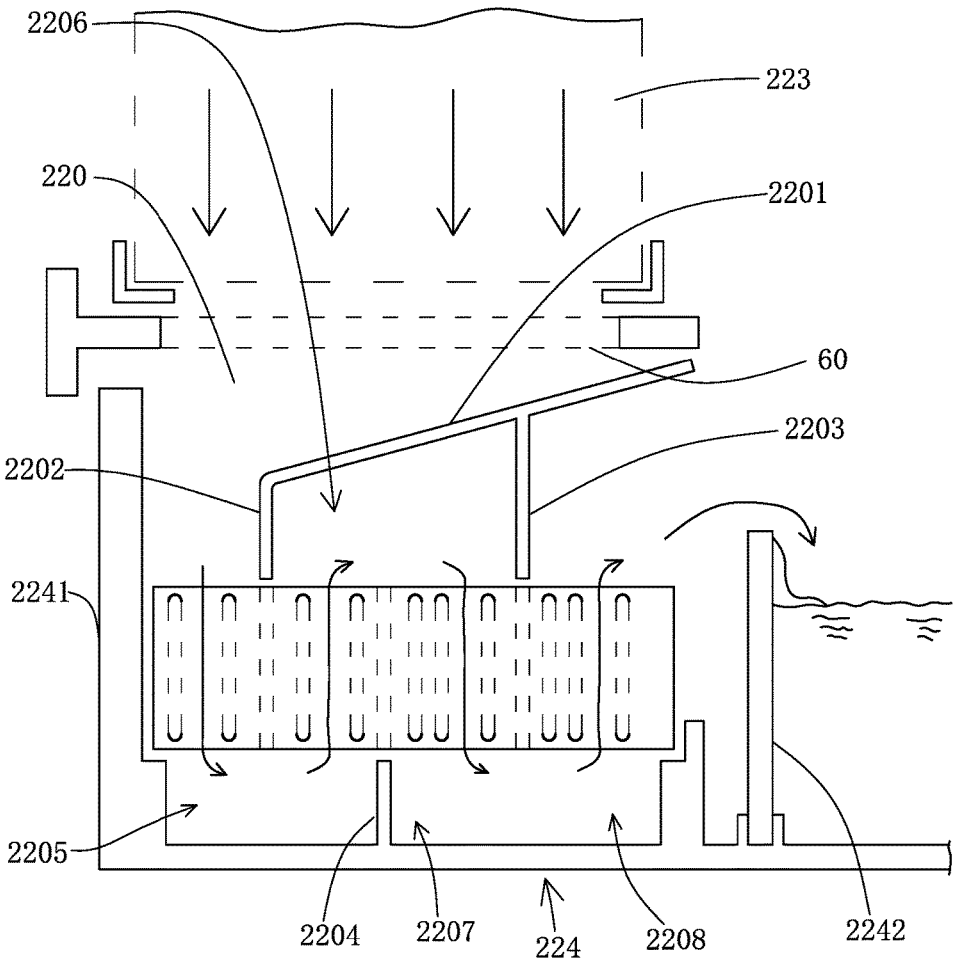
FIG. 12 is a schematic diagram of a bottom water collection basin according to the first preferred embodiment of the present invention.

Referring to FIG. 12 of the drawings, the water cooling unit 22 further comprises a filter 60 provided between the fill material unit 223 and the bottom water collection basin 224 for preventing unwanted substances from entering the bottom water collection basin 224.

The water cooling unit 22 further comprises a guiding arrangement 220 supported in the bottom water collection basin 224 for guiding the cooling water to flow in a predetermined pattern in the bottom water collection basin 224. More specifically, the guiding arrangement 220 comprises an inclined guiding member 2201, a first and a second vertical guiding members 2202, 2203 vertically extended in the bottom water collection basin 224, and a third vertical guiding member 2204. The inclined guiding member 2201 downwardly and inclinedly extends from one end of the filter 229 along a transverse direction thereof. The first through third vertical guiding members 2202, 2203, 2204 vertically extend in the bottom water collection basin 224 to divide the bottom water collection basin 224 into first through fourth heat exchanging chambers 2205, 2206, 2207, 2208. A predetermined number of heat exchanging pipes 225 are received in each of the heat exchanging chambers 2205, 2206, 2207, 2208.

As shown in FIG. 12 of the drawings, the first vertical guiding member 2202 extends from a distal end of the inclined guiding member 2201. The second vertical guiding member 2203 also downwardly extends from the inclined guiding member 2201, while the third vertical guiding member 2204 extends from a bottom wall of the bottom water collection basin 224 at a position between the first vertical guiding member 2202 and the second vertical guiding member 2203. A predetermined number of the heat exchanging pipes 225 is received in each of the heat exchanging chambers 2205, 2206, 2207, 2208. According to the first preferred embodiment of the present invention, the first heat exchanging chamber 2205 is formed between a sidewall 2241 of the bottom water collection basin 224 and the first vertical guiding member 2202. The second heat exchanging chamber 2206 is formed between first vertical guiding member 2202 and the third vertical guiding member 2204. The third heat exchanging chamber 2207 is formed between the third vertical guiding member 2204 and the second vertical guiding member 2203. The fourth heat exchanging chamber 2208 is formed between the second vertical guiding member 2203 and another sidewall 2242 of the bottom water collection basin 224.

It is important to mention that each particular heat exchanging chamber 2205 (2206) (2207) (2208) may communicate with an adjacent heat exchanging chamber so that the cooling water is guided to flow through the first through fourth heat exchanging chamber 2205, 2206, 2207, 2208 in a sequential manner.

The cooling water coming from the fill material unit 223 will hit the inclined guiding member 2201 and is guided to flow into the first heat exchanging chamber 2205 in a downward direction. The cooling water is arranged to perform heat exchange with the heat exchanging pipes 225 in the first heat exchanging chamber 2205. The cooling water is then guided to flow into the second heat exchanging chamber 2206 in an upward direction and perform heat exchange with the heat exchanging pipes 225 in the second heat exchanging chamber 2206. The cooling water is then guided to flow into the third heat exchanging chamber 2207 again in a downward direction and perform heat exchange with the heat exchanging pipes 225 in the third heat exchanging chamber 2207. Finally, the cooling water is then guided to flow into the fourth heat exchanging chamber 2208 in an upward direction and perform heat exchange with the heat exchanging pipes 225 in the fourth heat exchanging chamber 2208. Finally, the cooling water is then guided to flow into the water tank 213. The heat exchange process between the cooling water and the heat exchanging pipes 225 are for extracting heat from the refrigerant flowing through the heat exchanging pipes 225 to the cooling water, which is then pumped and guided to be cooled in the fill material unit 223.

Figure 13:
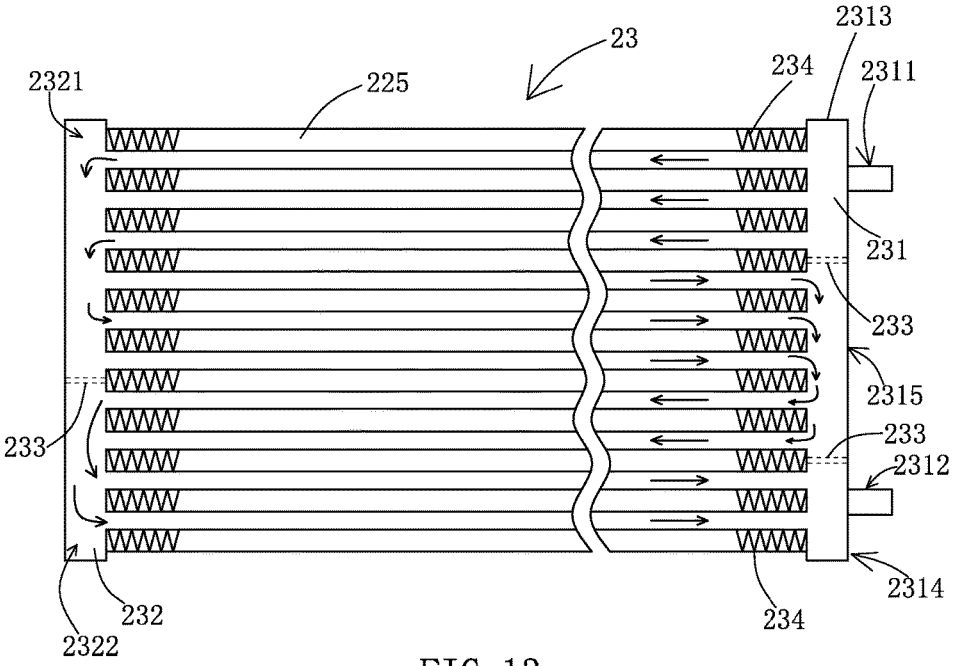
FIG. 13 is a schematic diagram of a refrigerant guiding system of the water-cooled split air conditioning system according to the first preferred embodiment of the present invention.
Figure 14:
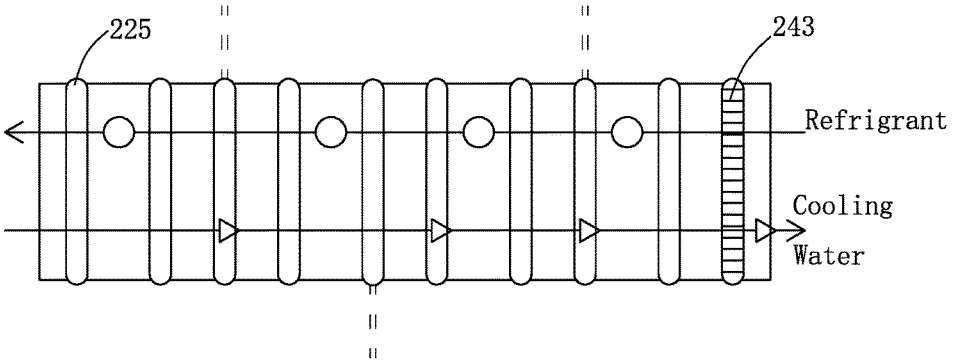
FIG. 14 is another schematic diagram of a refrigerant guiding system of the water-cooled split air conditioning system according to the first preferred embodiment of the present invention, illustrating the flow direction of the refrigerant and the cooling water.

Referring to FIG. 13 to FIG. 14 of the drawings, the water cooling unit 22 further comprises a refrigerant guiding system 23 connected to the heat exchanging pipes 225 to divide the heat exchanging pipes 225 into several piping groups so as to guide the refrigerant to flow through the various piping groups in a predetermined order.

Specifically, the refrigerant guiding system 23 comprises an inlet collection pipe 231 and a guiding pipe 232, wherein each of the heat exchanging pipes 225 has one end connected to the inlet collection pipe 231, and another end connected to the guiding pipe 232. As shown in FIG. 13 of the drawings, the inlet collection pipe 231 has a fluid inlet 2311 and a fluid outlet 2312. The refrigerant guiding system 23 further comprises a plurality of dividers 233 provided in at least one of the inlet collection pipe 231 and the guiding pipe 232 to divide the heat exchanging pipes 225 into a plurality of piping groups. Each of the dividers 233 prevents fluid from passing from one side of the divider 233 to the other side thereof.

According to the first preferred embodiment of the present invention, there are altogether ten heat exchanging pipes 225. Two dividers 233 are provided in the inlet collection pipe 231 to divide the inlet collection pipe 231 into an inlet portion 2313, an outlet portion 2314, and one intermediate portion 2315. The fluid inlet 2311 is formed on the inlet portion 2313, while the fluid outlet 2312 is formed on the outlet portion 2314. One divider 233 is also provided in the guiding pipe 232 to evenly divide the guiding pipe 232 into two portions 2321, 2322.

The ten heat exchanging pipes 225 in the water cooling unit 22 are divided into first through fourth piping groups. The first piping group is constituted by the three heat exchanging pipes 225 connecting to the inlet portion 2313 of the inlet collection pipe 231. The second piping group is constituted by the next three heat exchanging pipes 225 connecting to the intermediate portion 2315 of the inlet collection pipe 231 and the first portion of the guiding pipe 232. The third piping group is constituted by the next two heat exchanging pipes 225 connecting to the intermediate portion 2315 and the second portion of the guiding pipe 232. The fourth piping group is constituted by the remaining two heat exchanging pipes 225 connecting to the outlet portion 2314 of the inlet collection pipe 231.

The refrigerant enters the inlet collection pipe 231 through the fluid inlet 2311. The refrigerant entering the inlet collection pipe 231 is guided to flow through the first piping group and enter the first portion 2321 of the guiding pipe 232. The refrigerant is then guided by the divider 233 in the guiding pipe 232 to enter flow through the second piping group and re-enter the inlet collection pipe 231. The refrigerant is then guided to flow into the third piping group by the divider 233 and re-enter the second portion 2322 of the guiding pipe 232. The refrigerant is then guided to flow through the fourth piping group and enter the outlet portion 2314 of the inlet collection pipe 231. The refrigerant then exits the inlet collection pipe 231 through the fluid outlet 2312.

Moreover, the refrigerant guiding system 23 further comprises a plurality of heat exchanging fins 234 extended between each two adjacent heat exchanging pipes 225 for substantially increasing a surface area of heat exchanging process between the heat exchanging pipes 225 and the cooling water, and for reinforcing a structural integrity of the refrigerant guiding system 23. These heat exchanging fins 234 may be integrally extended from an outer surface of the heat exchanging pipes 225, or externally attached or welded on the outer surfaces of the first heat exchanging pipes 225. Moreover, each of the heat exchanging pipes 225 and heat exchanging fins 234 may have a thin layer of polytetrafluoroethylene formed on an exterior surface thereof to prevent unwanted substances from attaching on the exterior surfaces of the heat exchanging pipes 225 or the heat exchanging fins 234.

As shown in FIG. 14 of the drawings, the cooling water is guided to flow from the fourth piping group to the first piping group for maximizing heat exchange efficiency between the refrigerant and the cooling water. As a result, the first through fourth piping groups are accommodated in the fourth through first heat exchanging chambers 2208, 2207, 2206, 2205 respectively.

Figure 15:
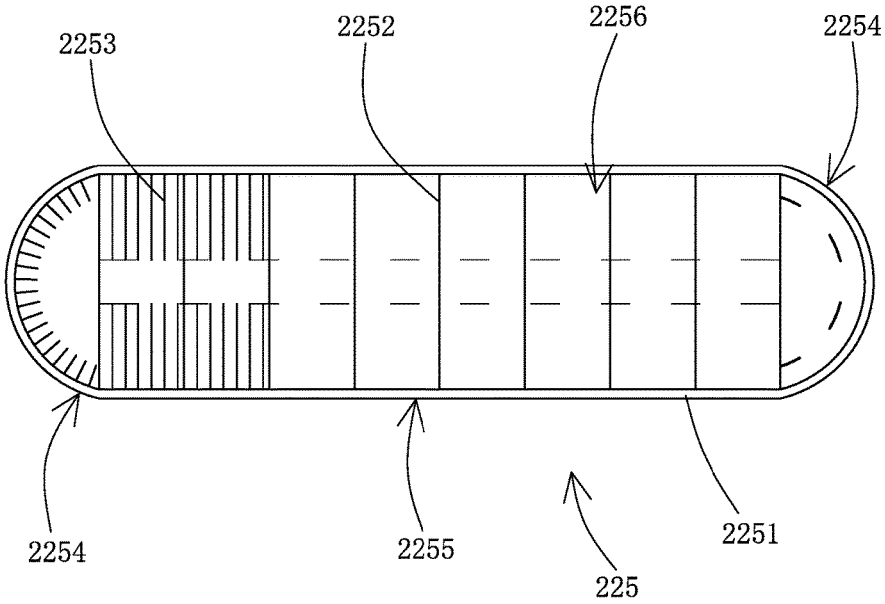
FIG. 15 is a sectional side view of a heat exchanging pipe according to the first preferred embodiment of the present invention.

Referring to FIG. 15 of the drawings, each of the first heat exchanging pipes 225 comprises a pipe body 2251, a plurality of retention members 2252 spacedly formed in the pipe body 2251, and a plurality of first heat exchanging fins 2253 extended from an inner surface of the pipe body 2251. The pipe body 2251 has two curved side portions 2254 and a substantially flat mid portion 2255 extending between the two curved side portions 2254 to form a rectangular cross sectional shape at the mid portion 2255 and two semicircular cross sectional shapes at two curved side portions 2254 of the heat exchanging pipe 225.

The retention members 2252 are spacedly distributed in the mid portion 2255 along a transverse direction of the corresponding pipe body 2251 so as to form a plurality of first pipe cavities 2256. Each of the retention members 2252 has a predetermined elasticity for reinforcing the structural integrity of the corresponding heat exchanging pipe 225. The heat exchanging fins 2253 are spacedly and evenly distributed along the inner surface of pipe body 251 for enhancing heat exchange performance between the refrigerant flowing through the corresponding heat exchanging pipe 225 and the cooling water.

According to the preferred embodiment of the present invention, each of the heat exchanging pipes 225 may be configured from aluminum which can be recycled and reused very conveniently and economically. In order to make the heat exchanging pipes 225 to resist corrosion and unwanted oxidation, each of the heat exchanging pipes 225 has a thin oxidation layer formed on an exterior surface and an interior surface thereof for preventing further corrosion of the relevant heat exchanging pipe. The formation of this thin oxidation layer can be by anode oxidation method.

Moreover, each of the heat exchanging pipes 225 may also have a thin layer of polytetrafluoroethylene or similar coating formed on an exterior surface thereof to prevent unwanted substances from attaching on the exterior surfaces of the heat exchanging pipes 225.

Figure 16:
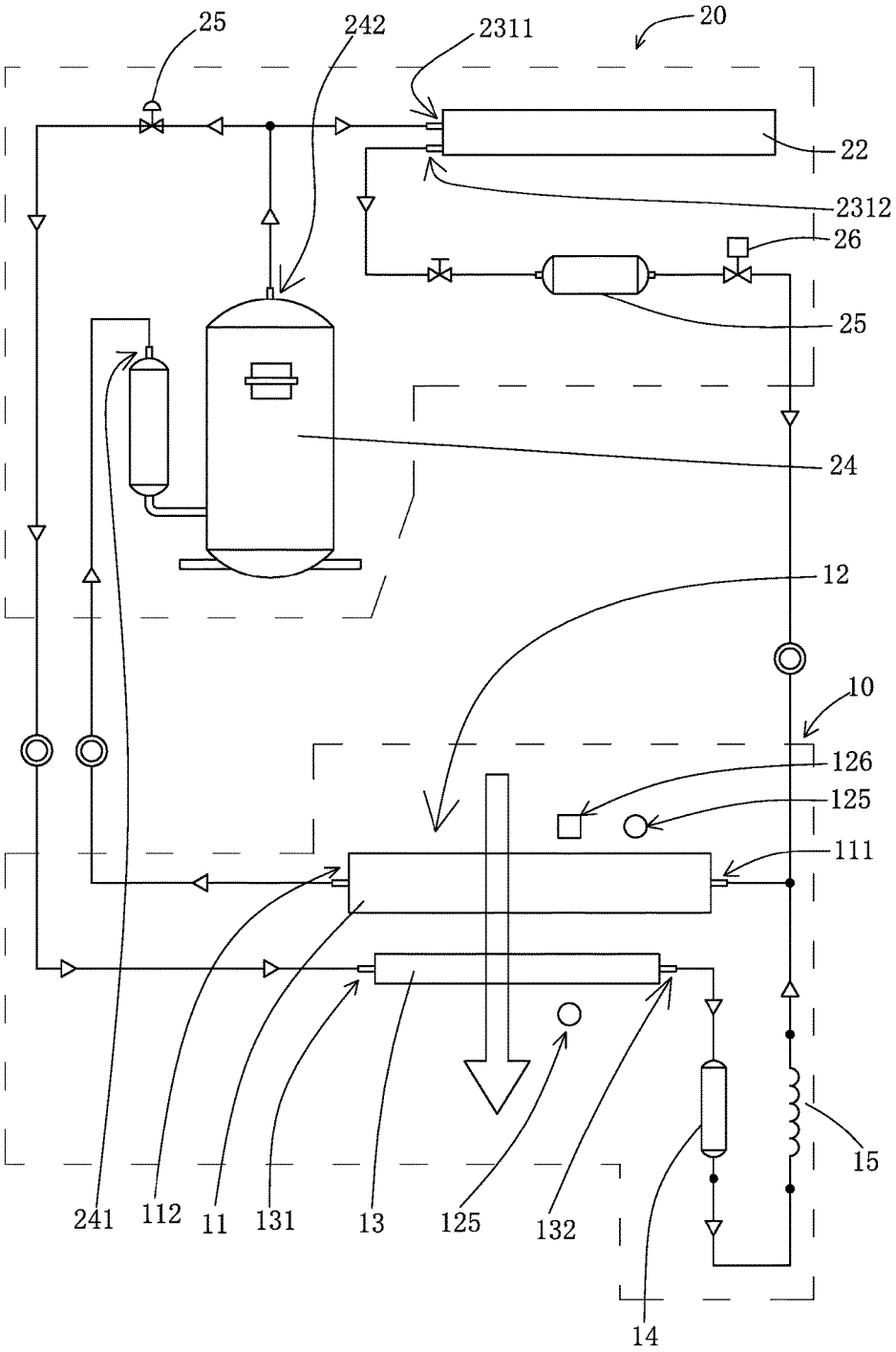
FIG. 16 is a block diagram of the water-cooled split air conditioning system according to the first preferred embodiment of the present invention.

Referring to FIG. 16 of the drawings, the outdoor unit 20 further comprises a compressor unit 24 having a compressor inlet 241 connected to the indoor unit 10, a compressor outlet 242 connected to the fluid inlet 2311 of the water cooling unit 22 and a dehumidifying unit 13 of the indoor fan coil unit 12, an outdoor filter unit 25 and a plurality of outdoor expansion valves 26 both connected to the fluid outlet 2312 of the water cooling unit 22 and the indoor fan coil unit 12.

Each of the indoor fan coil units 12 comprises the indoor heat exchanging unit 11 which is essentially an evaporator having an evaporator inlet 111 and an evaporator outlet 112, the dehumidifying unit 13 having a dehumidifier inlet 131 connected to the compressor outlet 242 of the compressor unit 24, and a dehumidifier outlet 132, an indoor filter unit 14 and an indoor expansion valve 15 connected to the evaporator inlet 111 of the indoor heat exchanging unit 11 and the dehumidifier outlet 132 of the dehumidifying unit 13. The flowing path of the refrigerant for dehumidifying is as follows:

The refrigerant leaves the compressor unit 24 through the compressor outlet 242 and is bifurcated into two refrigerant streams. The first stream flows through the outdoor expansion valve 26 and enters the dehumidifying unit 13 through the dehumidifier inlet 131. The refrigerant entering the dehumidifying unit 13 is arranged to release heat to the indoor space so as to raise the temperature of the space. The refrigerant then leaves the dehumidifying unit 13 through the dehumidifier outlet 132 and is guided to flow through the indoor filter unit 14 and indoor expansion valve 15. The second refrigerant stream enters the water cooling unit 22 which extracts heat from the refrigerant. The refrigerant then exits the water cooling unit 22 through the fluid outlet 2312 and flows through the outdoor expansion valves 26, and the outdoor filter unit 25 and is guided to merge with the first refrigerant stream coming out from the dehumidifying unit 13. The two streams of refrigerant merge and enter the indoor heat exchanging unit 11 through the evaporator inlet 111. The refrigerant is then guided to flow out of the indoor heat exchanging unit 11 for absorbing heat from the indoor space and ultimately flow back to the compressor unit 24. When the outdoor expansion valve 25 connecting to the compressor outlet 242 and the dehumidifier inlet 131 is closed, all the refrigerant coming out from the compressor outlet 242 will not be bifurcated and will be guided to flow through the water cooling unit 22.

As shown in FIG. 7 and FIG. 16 of the drawings, each of the indoor fan coil units 12 comprises an indoor housing 121 having an indoor air outlet 122 and an indoor air inlet 124, and an indoor ventilating unit (i.e. a fan) provided in the indoor housing 121. Air is drawn from the space in which the indoor unit 10 is located and is arranged to perform heat exchanging process with the refrigerant flowing through the indoor heat exchanging unit 11 and the dehumidifying unit 13. According to the first preferred embodiment of the present invention, air is first drawn to perform heat exchange with the indoor heat exchanging unit 11 and then to perform heat exchange with the dehumidifying unit 13.

Furthermore, each of the indoor fan coil unit 12 further comprises a plurality of temperature sensors 125 provide at the indoor air inlet 124 and the indoor air outlet 122 respectively, and a humidity sensor 126 provided at the indoor air inlet 124. When the relative humidity sensed by the humidity sensor 126 is above a predetermined threshold, the corresponding outdoor expansion valve 25 is switched on so as to allow the refrigerant coming out from the compressor unit 24 to flow into the dehumidifying unit 13 for decreasing the relative humidity of the air within the indoor space. The temperature sensor 125 provided at the indoor air outlet 122 is arranged to detect a temperature of the air coming out from the indoor air inlet 122. When the temperature is above a predetermined threshold, the corresponding outdoor expansion valve 25 is digitally adjusted so as to decrease the flow rate of the refrigerant entering the dehumidifying unit 13 for decreasing the temperature of the air coming out from the indoor air outlet 122.

Figure 17:
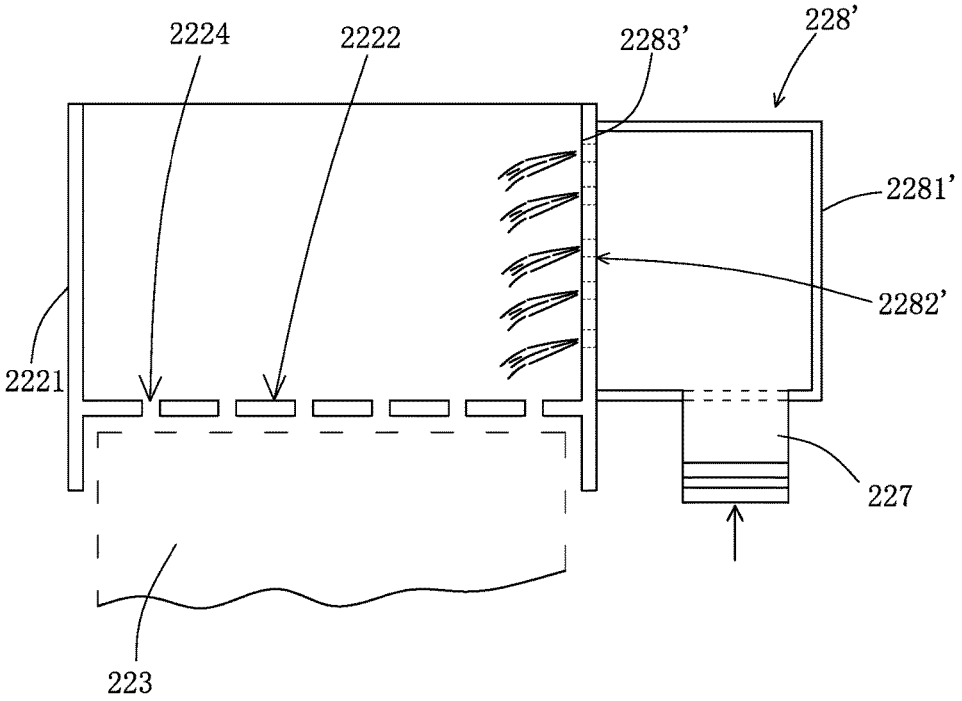
FIG. 17 is an alternative mode of the water-cooled split air conditioning system according to the first preferred embodiment of the present invention, illustrating an alternative configuration of a water distributor.
Figure 18:
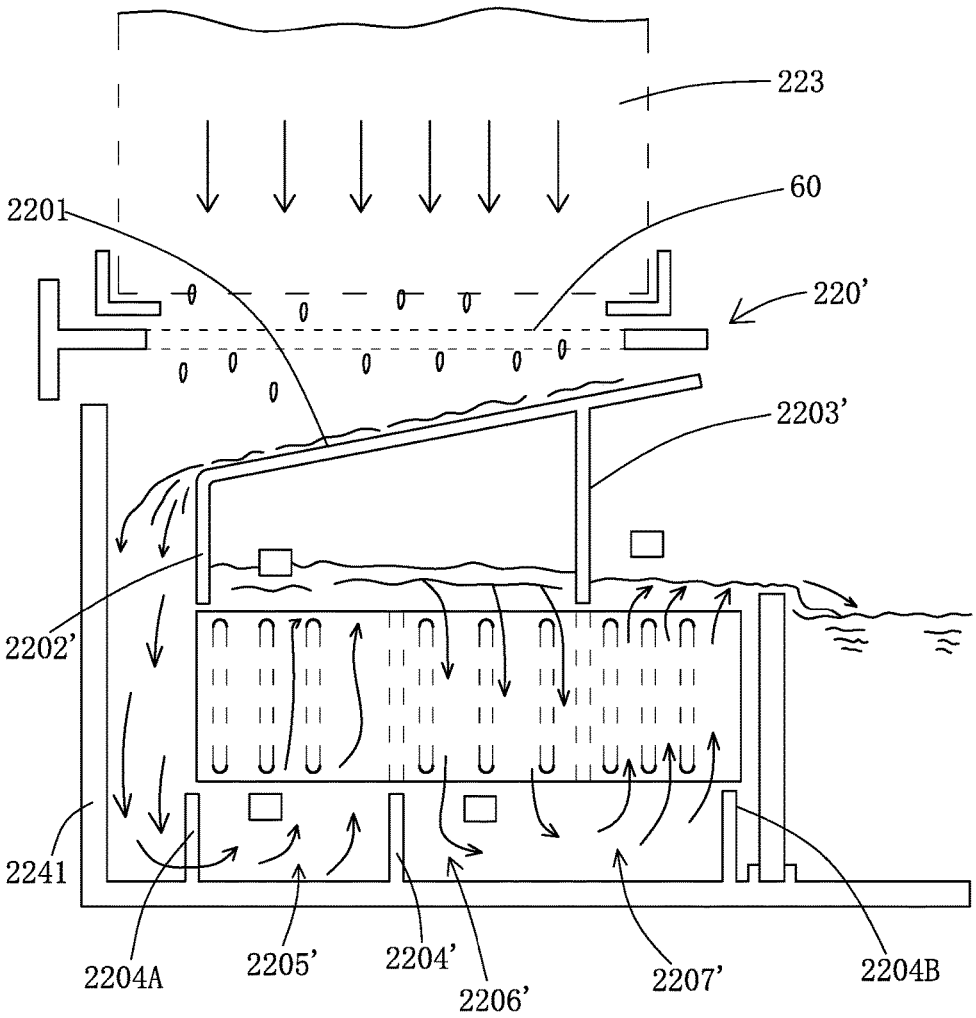
FIG. 18 is a schematic diagram of a guiding arrangement according to the alternative mode of the water-cooled split air conditioning system of the present invention.

Referring to FIG. 17 to FIG. 18 of the drawings, an alternative mode of the water-cooled split air conditioning system according to the preferred embodiment of the present invention is illustrated. The alternative mode is similar to the first preferred embodiment, except the water distributor 228' and the guiding arrangement 220'. According to the first alternative mode, the water distributor 228' comprises a water storage tank 2281' having a water distributing sidewall 2283', and contains a plurality of water distributing slots 2282' evenly formed on the water distributing sidewall 2283'. The water storage tank 2281' is communicated with the water tube 227. The cooling water is temporarily stored in the water storage tank 2281'. The water stored in the water storage tank 2281' is arranged to pass through the water distributing sidewall 2283' through the water distributing slots 2282'.

Referring to FIG. 18 of the drawings, the guiding arrangement 220' has first through third heat exchanging chamber 2205', 2206', 2207' formed by a first vertical guiding member 2202', a second vertical guiding member 2203', a third vertical guiding member 2204', a fourth vertical guiding member 2204A, and a fifth vertical guiding member 2204B, while the heat exchanging pipes 225' are divided into three piping groups, which are accommodated in the three heat exchanging chambers 2205', 2206', 2207' respectively. It is important to mention at this point that the number of heat exchanging pipes, the number of piping groups, and the number of heat exchanging chambers may be varied depending on the circumstances in which the present invention is operated.

Figure 19:
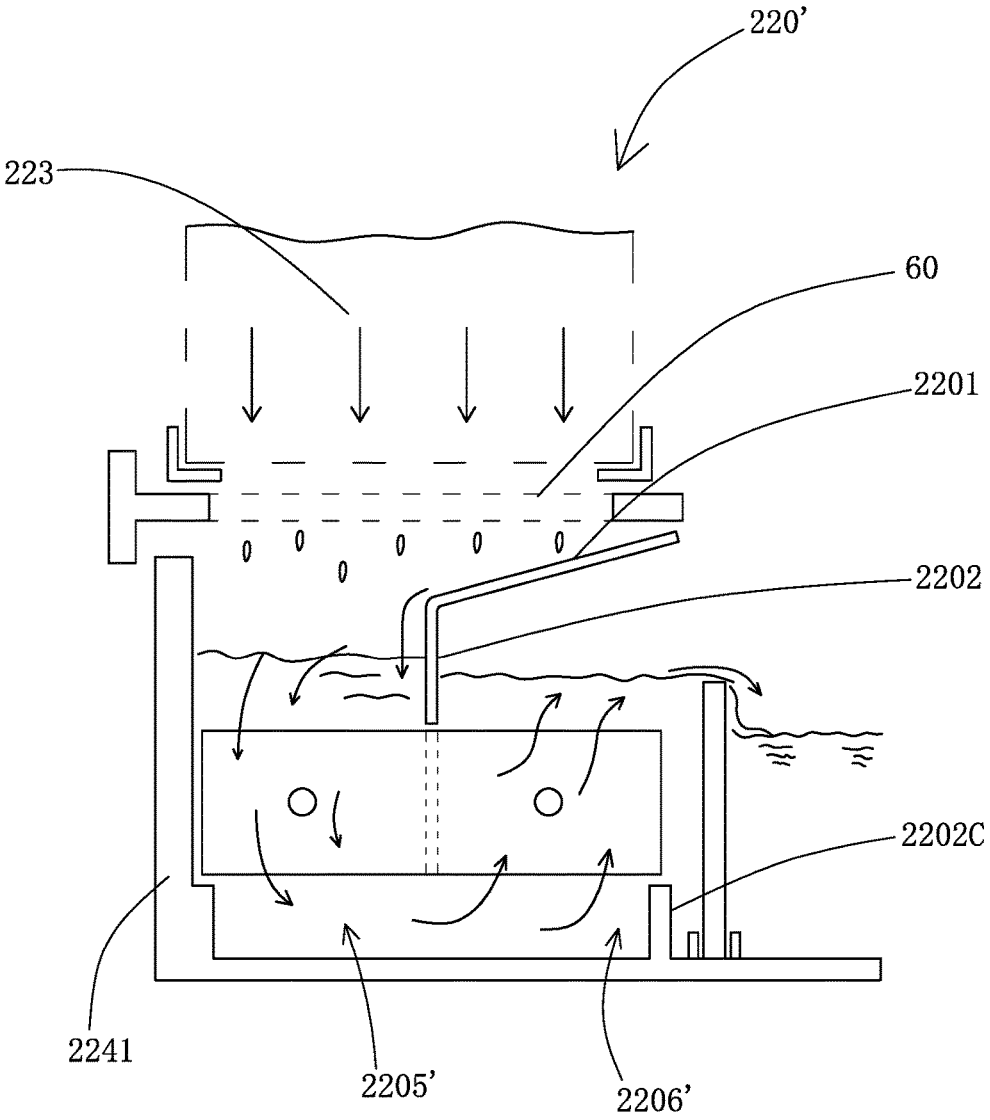
FIG. 19 is another variation of the guiding arrangement according to the alternative mode of the water-cooled split air conditioning system of the present invention.

An example variation is shown in FIG. 19 of the drawings, in which the guiding arrangement 220' has only two heat exchanging chambers formed by a two vertical guiding member 2202', 2202C, while the heat exchanging pipes 225' are divided into two piping groups.

Figure 20:
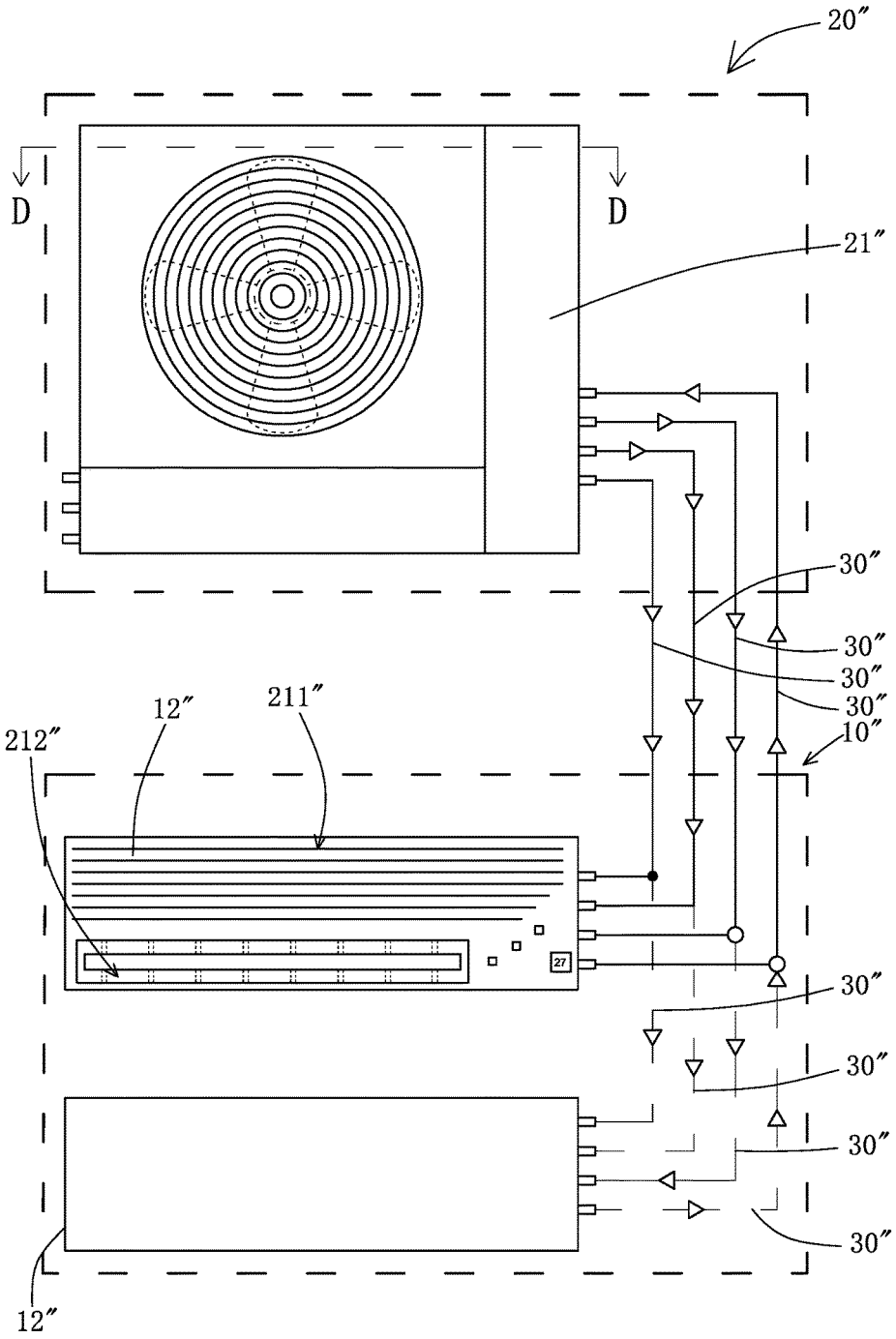
FIG. 20 is a schematic diagram of a water-cooled split air conditioning system according to a second preferred embodiment of the present invention.
Figure 21:
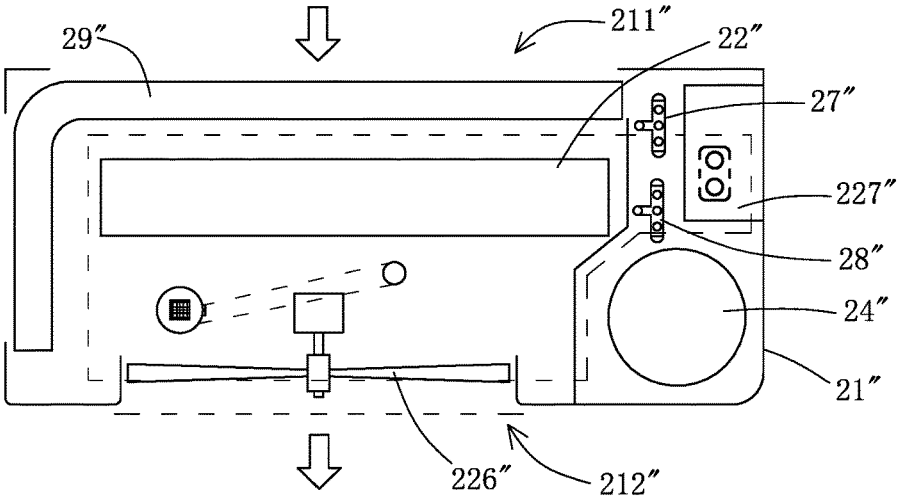
FIG. 21 is a sectional view of the water-cooled split air conditioning system along plane D-D of FIG. 20.
Figure 22:
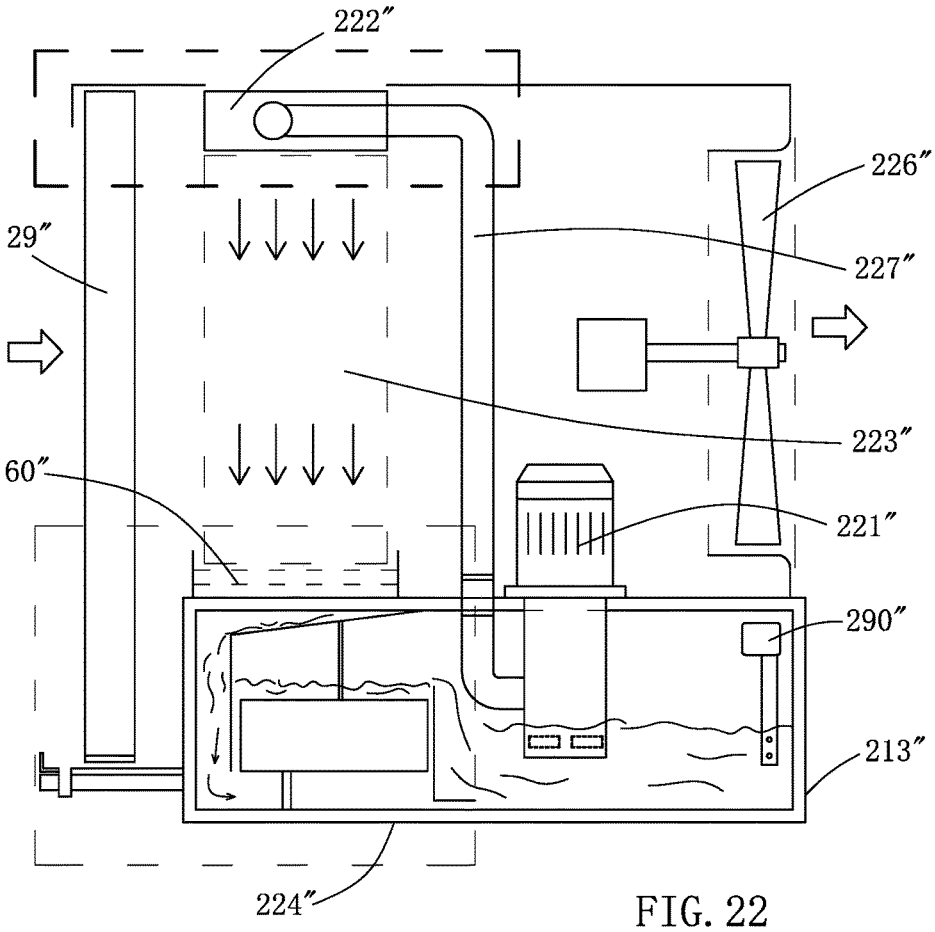
FIG. 22 is a sectional side view of an outdoor unit of the water-cooled split air conditioning system according to the second preferred embodiment of the present invention.

Referring to FIG. 20 to FIG. 22 of the drawings, a water-cooled split air conditioning system according to a second preferred embodiment of the present invention is illustrated. The second preferred embodiment is similar to the first preferred embodiment except that the water-cooled split air conditioning system may also be used as a heat pump type air conditioning system. Broadly, the water-cooled split air conditioning system comprises an indoor unit 10" comprising an indoor heat exchanging unit 11", an outdoor unit 20", and a plurality of connecting hoses 30". The water-cooled split air conditioning system utilizes a predetermined amount of working fluid, such as a predetermined amount of refrigerant, for performing heat exchange in various components of the system.

As shown in FIG. 21 of the drawings, the outdoor unit 20" comprises an outdoor housing 21" and a water cooling unit 22". The water cooling unit 22" comprises a pumping device 221", a top water collection basin 222", a fill material unit 223", a bottom water collection basin 224", and a plurality of heat exchanging pipes 225".

The outdoor housing 21" has an air inlet 211", an air outlet 212", and a water tank 213" for storing a predetermined amount of cooling water. The pumping device 22" is provided in the water tank 213" for pumping the cooling water from the water tank 213" to the top water collection basin 222", which is arranged to collect the cooling water from the pumping device 22".

The fill material unit 223" is provided underneath the top water collection basin 222", wherein the cooling water collected in the top water collection basin 222" is arranged to flow through the fill material unit 223".

The bottom water collection basin 224" is provided underneath the fill material unit 223". The cooling water coming from the fill material unit 223" is arranged to pass through a filter 60" and to be collected in the bottom water collection basin 224".

The heat exchanging pipes 225" are provided in the bottom water collection basin 224" and are arranged to immerse in the cooling water. The cooling water collected in the bottom water collection tank 224" is arranged to be guided to flow back into the top water collection basin 222". At the same time, a predetermined amount of refrigerant is arranged to flow through the heat exchanging pipes 225" in such a manner that the refrigerant is arranged to perform highly efficient heat exchanging process with the cooling water for lowering a temperature of the refrigerant. Furthermore, a predetermined amount of air is drawn from the air inlet 211" for performing heat exchange with the cooling water flowing through the fill material unit 223" for lowering a temperature of the cooling water. The air having absorbed the heat from the cooling water is discharged out of the indoor housing 21" through the air outlet 213".

The connecting hoses 30" connect the indoor unit 10" to the outdoor unit 20" for allowing the refrigerant to circulate between the indoor unit 10 and the outdoor unit 20".

According to the second preferred embodiment of the present invention, the indoor unit 10" is arranged to simultaneously connect to two indoor fan coil units 12". As shown in FIG. 20 of the drawings, a single outdoor unit 20" is connected to two indoor fan coil units 12" each having the indoor heat exchanging unit 11". Furthermore, there are at least four connecting hoses 30" connecting the two indoor fan coil units 12" to the outdoor unit 20".

As shown in FIG. 21 and FIG. 22 of the drawings, the outdoor unit 20" further comprises a fan unit 226" provided in the outdoor housing 21" for drawing ambient air to flow between the air inlet 211" and the air outlet 212". Thus, the fan unit 226" is positioned at one side of the fill material unit 223" for drawing ambient air to flow along a transverse direction of the fill material unit 223". Moreover, the outdoor unit 20" further comprises a power supply 227", a compressor unit 24", a first four-way valve 27", a second four-way valve 28" and an outdoor heat exchanging unit 29" provided at a peripheral portion of the outdoor housing 21".

The water tank 213" and the bottom water collection basin 224" are positioned in a side-by-side manner. The cooling water collected in the bottom water collection basin 224" is guided to flow into the water tank 213", which is then pumped back to the top water collection basin 222" by the pumping device 221" via a water tube 227".

Figure 23:
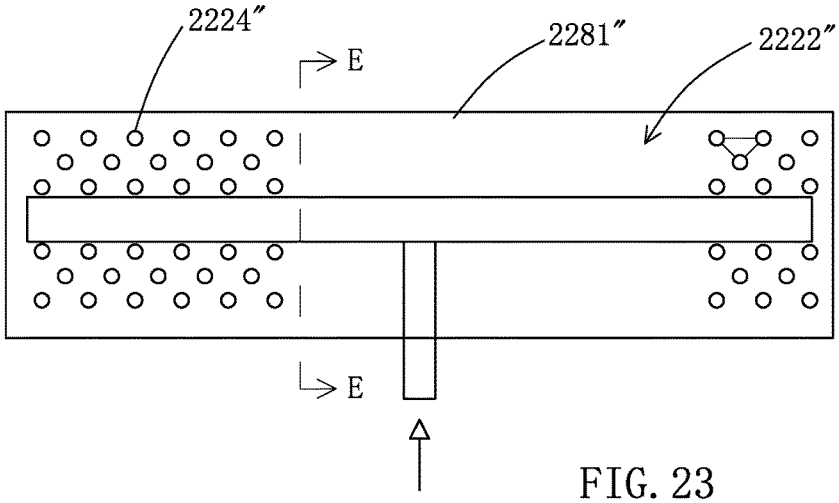
FIG. 23 is a plan view of a top water collection basin of the water-cooled split air conditioning system according to the second preferred embodiment of the present invention.
Figure 24:
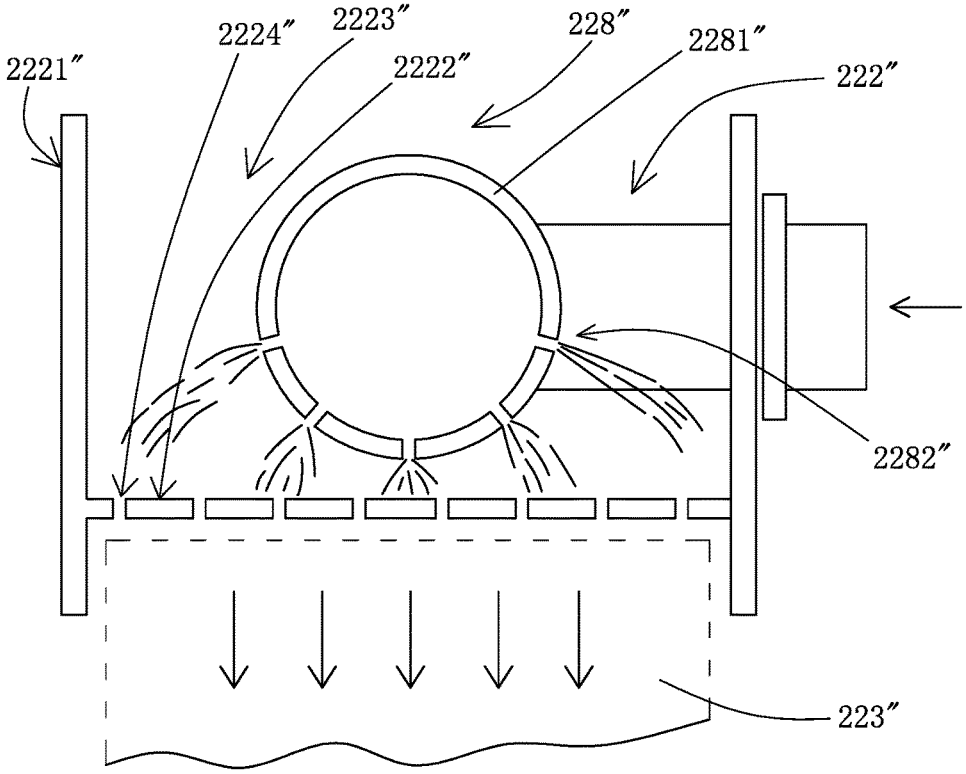
FIG. 24 is a section side view of the top water collection basin along plane E-E of FIG. 23.
Figure 25:
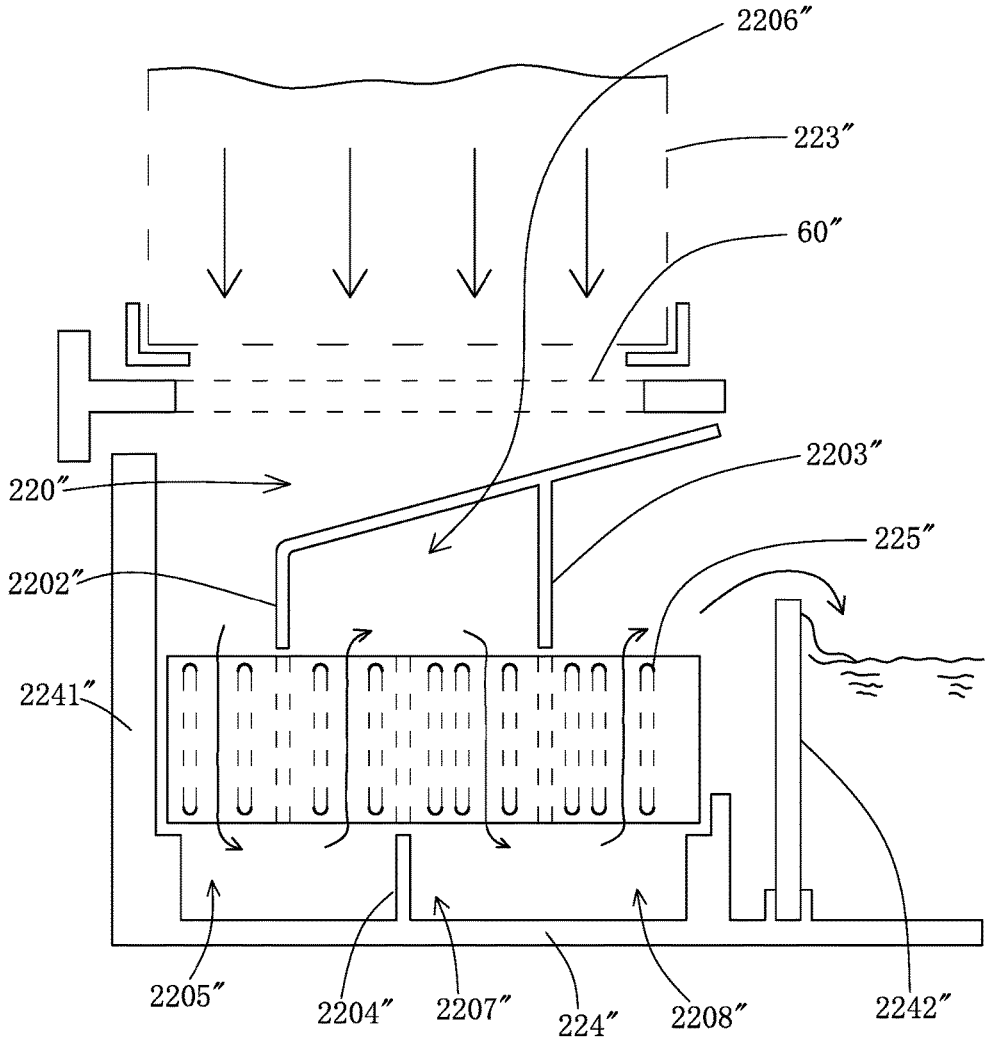
FIG. 25 is a schematic diagram of a bottom water collection basin according to the second preferred embodiment of the present invention.

Referring to FIG. 23 to FIG. 25 of the drawings, the top water collection basin 222" has at least one peripheral sidewall 2221" and a bottom wall 2222" to define a storing cavity 2223" between the peripheral sidewall 2221" and the bottom wall 2222". The cooling water coming from the water tank 213" is arranged to be stored in the storing cavity 2223". The bottom wall 2222" has a plurality of passage holes 2224", wherein the cooling water stored in the storing cavity 2223" may flow onto the fill material unit 223" through the passage holes 2224".

Furthermore, the passage holes 2224" are distributed along the bottom wall 2222" in a predetermined array, wherein a center of each of the passage holes 2224" in a particular row is arranged not to align with that of the passage holes 2224" in the next row. Moreover, each two adjacent passage holes 2224" of an upper row thereof is arranged to form a triangular distribution with a corresponding passage hole 2224" of the adjacent row of the passage holes 2224", as shown in FIG. 23 of the drawings. All of the passage holes 2224" have an identical shape and size.

The water cooling unit 22" further comprises a water distributor 228" provided on a top end portion of the water tube 227" for distributing the cooling water into the storing cavity 2223" of the top water collection basin 222". Specifically, the water distributor 228" comprises a distributor tube 2281" longitudinally extended along a longitudinal direction of the top water collection basin 222", and a plurality of distributing slots 2282" formed on the distributor tube 2281". The cooling water flowing in the water tube 227" is allowed to flow into the distributor tube 2281" and then into the storing cavity 2223" via the distributing slots 2282". The distributor tube 2281" has a substantially circular cross section. The distributing slots 2282" are evenly formed on a lower circular portion of the distributor tube 2281" so that the cooling water can be evenly spread on the bottom wall 2222" of the top water collection basin 222". The evenly distributed cooling water in the storing cavity 2223" is then allowed to flow onto the fill material unit 223" via the evenly distributed passage holes 2224" as shown in FIG. 24 of the drawings. These structures ensure that a water thin film can be evenly formed in the fill material unit 223" as the cooling water flows downwardly along the fill material unit 223".

Referring to FIG. 22 of the drawings, the water cooling unit 22" further comprises a filter 60" provided between the fill material unit 223" and the bottom water collection basin 224" for preventing unwanted substances from entering the bottom water collection basin 224".

The water cooling unit 22" further comprises a guiding arrangement 220" supported in the bottom water collection basin 224" for guiding the cooling water to flow in a predetermined pattern in the bottom water collection basin 224". More specifically, the guiding arrangement 220" comprises an inclined guiding member 2201", a first and a second vertical guiding members 2202", 2203" vertically extended in the bottom water collection basin 224", and a third vertical guiding member 2204". The inclined guiding member 2201" downwardly and inclinedly extends from one end of the filter 60" along a transverse direction thereof. The first through third vertical guiding members 2202", 2203", 2204" vertically extend in the bottom water collection basin 224" to divide the bottom water collection basin 224" into first through fourth heat exchanging chambers 2205", 2206", 2207", 2208". A predetermined number of heat exchanging pipes 225" are received in each of the heat exchanging chambers 2205", 2206", 2207", 2208". As shown in FIG. 25 of the drawings, the first vertical guiding member 2202" extends from a distal end of the inclined guiding member 2201". The second vertical guiding member 2203" also downwardly extends from the inclined guiding member 2201", while the third vertical guiding member 2204" extends from a bottom wall of the bottom water collection basin 224" at a position between the first vertical guiding member 2202" and the second vertical guiding member 2203". A predetermined number of the heat exchanging pipes 225" is received in each of the heat exchanging chambers 2203".

According to the preferred embodiment of the present invention, the first heat exchanging chamber 2205" is formed between a sidewall 2241" of the bottom water collection basin 224" and the first vertical guiding member 2202". The second heat exchanging chamber 2206" is formed between first vertical guiding member 2202" and the third vertical guiding member 2204". The third heat exchanging chamber 2207" is formed between the third vertical guiding member 2204" and the second vertical guiding member 2203". The fourth heat exchanging chamber 2208" is formed between the second vertical guiding member 2203" and another sidewall 2242" of the bottom water collection basin 224".

As in the first preferred embodiment, each particular heat exchanging chamber may communicate with an adjacent heat exchanging chamber so that the cooling water is guided to flow through the first through fourth heat exchanging chamber 2205", 2206", 2207", 2208" in a sequential manner.

The cooling water coming from the fill material unit 223" will hit the inclined guiding member 2201" and is guided to flow into the first heat exchanging chamber 2205" in a downward direction. The cooling water is arranged to perform heat exchange with the heat exchanging pipes 225" in the first heat exchanging chamber 2205". The cooling water is then guided to flow into the second heat exchanging chamber 2206" in an upward direction and perform heat exchange with the heat exchanging pipes 225" in the second heat exchanging chamber 2206". The cooling water is then guided to flow into the third heat exchanging chamber 2207" again in a downward direction and perform heat exchange with the heat exchanging pipes 225" in the third heat exchanging chamber 2207". Finally, the cooling water is then guided to flow into the fourth heat exchanging chamber 2208" in an upward direction and perform heat exchange with the heat exchanging pipes 225" in the fourth heat exchanging chamber 2208". The cooling water is then guided to flow into the water tank 213".

Figure 26:
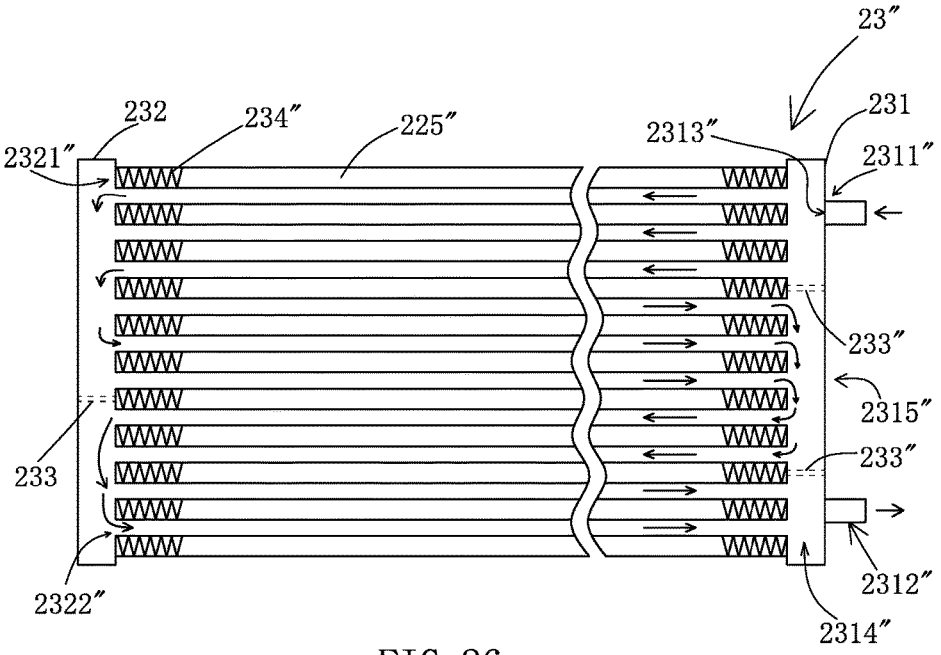
FIG. 26 is a schematic diagram of a refrigerant guiding system of the water-cooled split air conditioning system according to the second preferred embodiment of the present invention.
Figure 27:
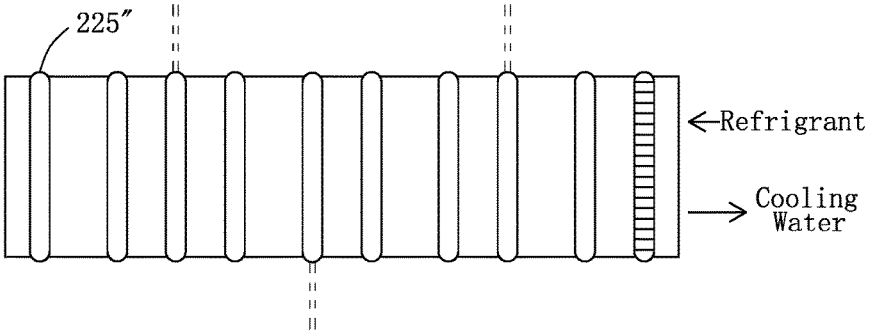
FIG. 27 is another schematic diagram of a refrigerant guiding system of the water-cooled split air conditioning system according to the second preferred embodiment of the present invention, illustrating the flow direction of the refrigerant and the cooling water.

Referring to FIG. 26 to FIG. 27 of the drawings, the water cooling unit 22" further comprises a refrigerant guiding system 23" connected to the heat exchanging pipes 225" to divide the heat exchanging pipes 225" into several piping groups so as to guide the refrigerant to flow through the various piping groups in a predetermined order.

Specifically, the refrigerant guiding system 23" comprises an inlet collection pipe 231" and a guiding pipe 232", wherein each of the heat exchanging pipes 225" has one end connected to the inlet collection pipe 231", and another end connected to the guiding pipe 232". As shown in FIG. 26 of the drawings, the inlet collection pipe 231" has a fluid inlet 2311" and a fluid outlet 2312". The refrigerant guiding system 23" further comprises a plurality of dividers 233" provided in at least one of the inlet collection pipe 231" and the guiding pipe 232" to divide the heat exchanging pipes 225" into a plurality of piping groups. Each of the dividers 233" prevents fluid from passing from one side of the divider 233" to the other side thereof.

According to the second preferred embodiment of the present invention, there are altogether ten heat exchanging pipes 225". Two dividers 233" are provided in the inlet collection pipe 231" to divide the inlet collection pipe 231" into an inlet portion 2313", an outlet portion 2314", and one intermediate portion 2315". The fluid inlet 2311" is formed on the inlet portion 2313", while the fluid outlet 2312" is formed on the outlet portion 2314". One divider 233" is also provided in the guiding pipe 232" to evenly divide the guiding pipe 232" into two portions 2321", 2322".

The ten heat exchanging pipes 225" in the water cooling unit 22" are divided into first through fourth piping groups. The first piping group is constituted by the three heat exchanging pipes 225" connecting to the inlet portion 2313" of the inlet collection pipe 231". The second piping group is constituted by the next three heat exchanging pipes 225" connecting to the intermediate portion 2315" of the inlet collection pipe 231" and the first portion of the guiding pipe 232". The third piping group is constituted by the next two heat exchanging pipes 225" connecting to the intermediate portion 2315" and the second portion of the guiding pipe 232". The fourth piping group is constituted by the remaining two heat exchanging pipes 225" connecting to the outlet portion 2314" of the inlet collection pipe 231".

The refrigerant enters the inlet collection pipe 231" through the fluid inlet 2311". The refrigerant entering the inlet collection pipe 231" is guided to flow through the first piping group and enter the first portion 2321" of the guiding pipe 232". The refrigerant is then guided by the divider 233" in the guiding pipe 232" to enter flow through the second piping group and re-enter the inlet collection pipe 231". The refrigerant is then guided to flow into the third piping group by the divider 233" and re-enter the second portion 2322" of the guiding pipe 232". The refrigerant is then guided to flow through the fourth piping group and enter the outlet portion 2314" of the inlet collection pipe 231". The refrigerant then exits the inlet collection pipe 231" through the fluid outlet 2312".

Moreover, the refrigerant guiding system 23" further comprises a plurality of first heat exchanging fins 234" extended between each two adjacent heat exchanging pipes 225" for substantially increasing a surface area of heat exchange between the heat exchanging pipes 225" and the cooling water, and for reinforcing a structural integrity of the refrigerant guiding system 23". These heat exchanging fins 234" may be integrally extended from an outer surface of the heat exchanging pipes 225", or externally attached or welded on the outer surfaces of the first heat exchanging pipes 225".

As shown in FIG. 27 of the drawings, the cooling water is guided to flow from the fourth piping group to the first piping group for maximizing heat exchange efficiency between the refrigerant and the cooling water. As a result, the first through fourth piping groups are accommodated in the fourth through first heat exchanging chambers 2208", 2207", 2206", 2205" respectively.

Figure 28:
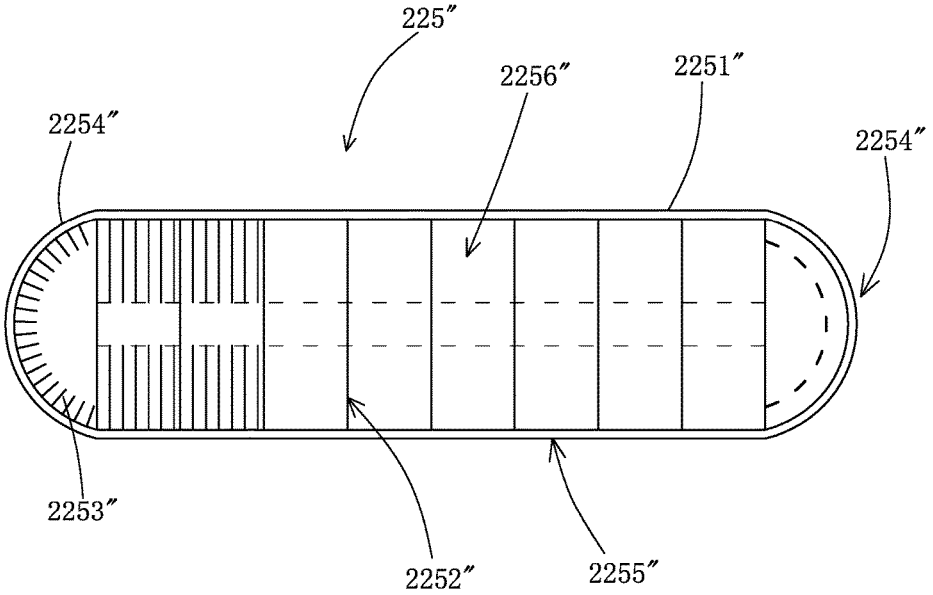
FIG. 28 is a sectional side view of a heat exchanging pipe according to a second preferred embodiment of the present invention.

Referring to FIG. 28 of the drawings, each of the first heat exchanging pipes 225" comprises a pipe body 2251", a plurality of retention members 2252" spacedly formed in the pipe body 2251", and a plurality of first heat exchanging fins 2253" extended from an inner surface of the pipe body 2251". The pipe body 2251" has two curved side portions 2254" and a substantially flat mid portion 2255" extending between the two curved side portions 2254" to form a rectangular cross sectional shape at the mid portion 2255" and two semicircular cross sectional shapes at two curved side portions 2254" of the heat exchanging pipe 225".

The retention members 2252" are spacedly distributed in the mid portion 2255" along a transverse direction of the corresponding pipe body 2251" so as to form a plurality of first pipe cavities 2256". Each of the retention members 2252" has a predetermined elasticity for reinforcing the structural integrity of the corresponding heat exchanging pipe 225". The heat exchanging fins 2253" are spacedly and evenly distributed along the inner surface of pipe body 251" for enhancing heat exchange performance between the refrigerant flowing through the corresponding heat exchanging pipe 225" and the cooling water.

According to the second preferred embodiment of the present invention, each of the heat exchanging pipes 225" may be configured from aluminum which can be recycled and reused very conveniently and economically. Each of the heat exchanging pipes 225" has a thin oxidation layer formed on an exterior surface and an interior surface thereof for preventing further corrosion of the relevant heat exchanging pipe 225". The formation of this thin oxidation layer can be by anode oxidation method. Moreover, as in the first preferred embodiment of the present invention, each of the heat exchanging pipes 225" may also have a thin layer of polytetrafluoroethylene or similar coating formed on an exterior surface thereof to prevent unwanted substances from attaching on the exterior surfaces of the heat exchanging pipes 225".

Figure 29:
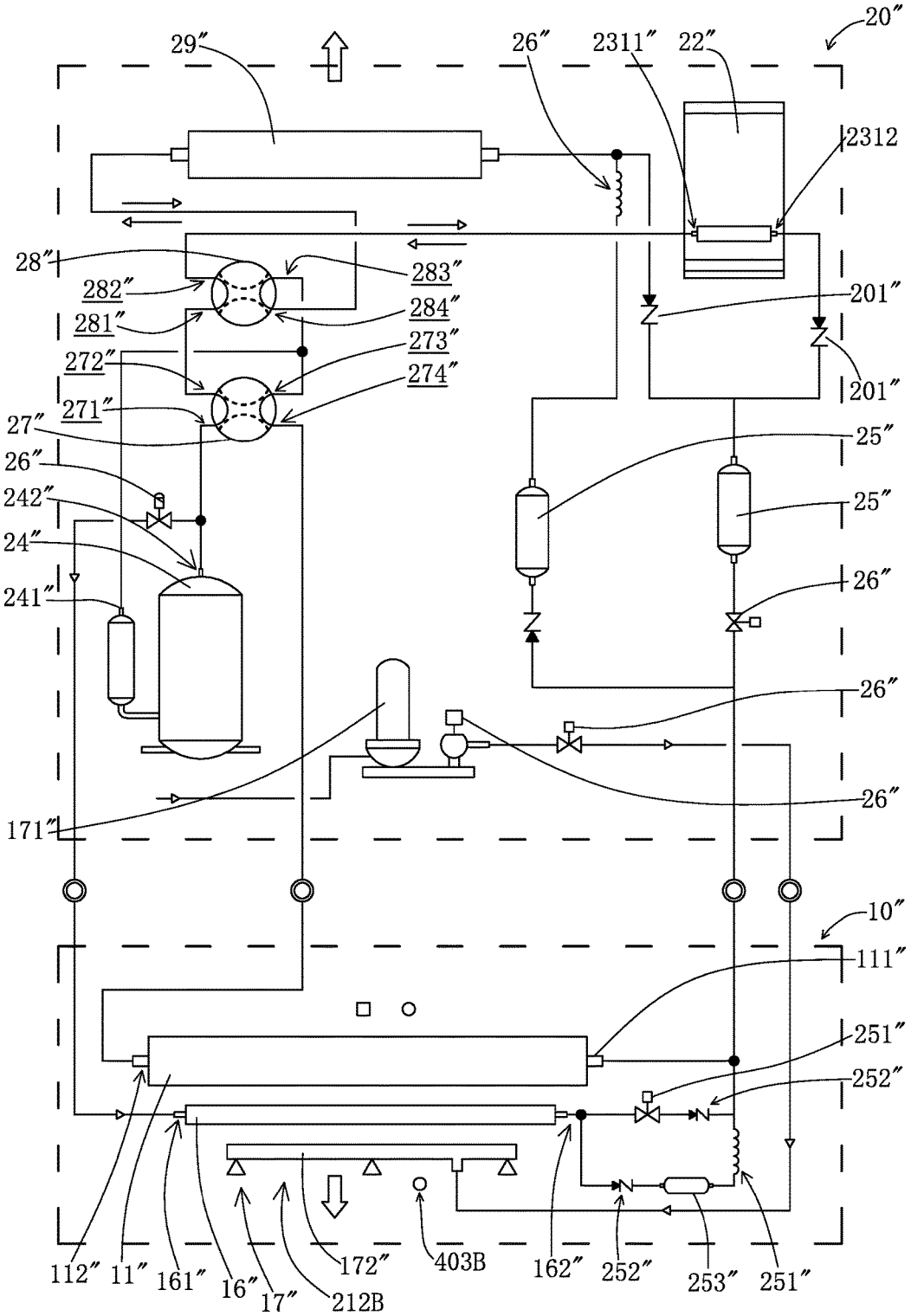
FIG. 29 is a block diagram of the water-cooled split air conditioning system according to the first preferred embodiment of the present invention.

FIG. 29 illustrates a block diagram of the various components of the water-cooled split air conditioning system according to the second preferred embodiment of the present invention. In this second preferred embodiment, the water-cooled split air conditioning system may also act as a heat pump for delivering heat to a predetermined space.

The outdoor unit 20" comprises a compressor unit 24" having a compressor inlet 241" connected to the indoor unit 10", a compressor outlet 242", an outdoor heat exchanging unit 29", the water cooling unit 22", a first four-way valve 27", a second four-way valve 28", a plurality of outdoor filter units 25", a plurality of outdoor expansion valves 26", and a plurality of outdoor unidirectional valves 201".

As shown in FIG. 29 of the drawings, the compressor unit 24" is connected to the outdoor heat exchanging unit 29" through the first four-way valve 27" and the second four-way valve 28". The outdoor heat exchanging unit 29" is connected to the water cooling unit 22" through a predetermined number of the outdoor filter units 25", the outdoor expansion valves 26" and the outdoor unidirectional valves 201". Both the water cooling unit 22" and the outdoor heat exchanging unit 29" are also connected to the indoor unit 10". The first four-way valve 27" has first through fourth connecting ports 271", 272", 273", 274", while the second four-way valve 28" has fifth through eighth connecting ports 281", 282", 283", 284". The first connecting port 271" can be selectively connected to the second port 272" and the fourth port 274", while the third port 273" can be selectively connected to the fourth port 274" and the second port 272". Similarly, the fifth port 281" can be selectively connected to sixth port 282" and the eighth port 284", while the seventh port 283" can be selectively connected to the sixth port 282" and the eighth port 284".

The indoor unit 10" further comprises the first indoor heat exchanging unit 11" and a second indoor heat exchanging unit 16". The first indoor heat exchanging unit 11" has a first heat exchanging inlet 111" and a first heat exchanging outlet 112". The second heat exchanging unit 16" has a second heat exchanging inlet 161" and a second heat exchanging outlet 162". The indoor unit 10" further comprises a humidifying device 17" communicated with the second indoor heat exchanging unit 16".

When the water-cooled split air conditioning system is utilized as an air conditioning system (i.e. extracting heat from the indoor space), heated or steam refrigerant is arranged to leave the compressor unit 24" through the compressor outlet 242". The first connecting port 271" is connected to the second connecting port 272", while the third connecting port 273" is connected to the fourth connecting port 274". For the second four-way valve 28", the fifth connecting port 281" is connected to the sixth connecting port 282", while the seventh connecting port 283" is connected to the eighth connecting port 284".

The refrigerant leaving the compressor unit 24" is arranged to flow into the fluid inlet 2311" of the refrigerant guiding system 23" through the first connecting port 271" and the second connecting port 272" of the first four-way valve 27" and the fifth connecting port 281" and the sixth connecting port 282" of the second four-way valve 28". The refrigerant is then cooled in the water cooling unit 22" in the manner described above. After the refrigerant is cooled, the refrigerant leaves the water cooling unit 22" and enters the indoor unit 10" through a predetermined number of the outdoor unidirectional valve 201", the outdoor expansion valve 26" and the outdoor filter unit 25". The connection between the indoor unit 10" and the outdoor unit 20" is by at least one of the connecting hoses 30". The refrigerant entering the indoor unit 10" is guided to enter the first indoor heat exchanging unit 11" (through the first heat exchanging inlet 111") which is arranged to absorb heat from the indoor space. The refrigerant absorbs heat from a heat exchange medium which carries the heat of the space (i.e. air), and exits the first heat exchanging unit 11" through the first heat exchanging outlet 112". The refrigerant then passes through the fourth connecting port 274" and the third connecting port 273" and eventually goes back to the compressor unit 24" through the compressor inlet 241". This completes one refrigerant cycle when the water-cooled split air conditioning system is utilized as an air conditioning system. The absorbed heat is then extracted in the water cooling unit 22" again in the manner as described above.

At the same time, the water-cooled split air conditioning system may also be used for dehumidifying purpose when it is used as an air conditioning system. In this scenario, the heated refrigerant coming out from the compressor outlet 242" is guided by a corresponding outdoor expansion valve 26" to enter the second indoor heat exchanging unit 16" for releasing heat to the indoor space. The refrigerant may become liquid state and exits the second indoor heat exchanging unit 16" through the second heat exchanging outlet 162" and merge with the refrigerant coming from the water cooling unit 22". The merged refrigerant is then arranged to enter the first indoor heat exchanging unit 11" through the first indoor heat exchanging inlet 111" for absorbing heat from the indoor space. The refrigerant then exists the first indoor heat exchanging unit 11" through the first indoor heat exchanging outlet 112" and passes through the fourth connecting port 274" and the third connecting port 273" of the first four-way valve 27". Finally, the refrigerant is guided to flow back to the compressor unit 24" through the compressor inlet 241". This completes a refrigerant cycle for dehumidifying purpose.

In this second preferred embodiment of the present invention, the water-cooled split air conditioning system may be used as a heat pump. As shown in FIG. 29 of the drawings, the first four-way valve 27" is switched so that the first connecting port 271" is connected to the fourth connecting port 274" while the second connecting port 272" is connected to the third connecting port 273". The refrigerant leaving the compressor unit 24" through the compressor outlet 242" is bifurcated into two refrigerant streams. The first refrigerant stream passes through the first connecting port 271", the fourth connecting port 274" and reaches the first indoor heat exchanging unit 11" for releasing heat to the indoor space. The second refrigerant stream passes through an outdoor expansion valve 26" and enters the second indoor heat exchanging unit 16". The second refrigerant stream then passes through a predetermined number of indoor expansion valve 251", indoor unidirectional valve 252", indoor filter unit 253" and merges with the first refrigerant stream coming out from the first indoor heat exchanging unit 11". The merged refrigerant then flows into the outdoor heat exchanging unit 29" via a corresponding outdoor filter unit 25" and a corresponding outdoor expansion valve 26". The refrigerant then absorbs heat in the outdoor heat exchanging unit 29" and is guided to flow through the eight connecting port 284", the seventh connecting port 283", and finally back to the compressor unit 24".

When the water-cooled split air conditioning system is used as a heat pump for delivering heat to the indoor space, the water cooling unit 22" is idle. However, residual refrigerant must be guided to flow back to the main system. The residual refrigerant leaves the water cooling unit 22" through the fluid inlet 2311", and is guided to flow through the sixth connecting port 282", the fifth connecting port 281", the second connecting port 272", the third connecting port 273", and finally back to the compressor unit 24".

Moreover, the water-cooled split air conditioning system may also be used for defrosting purpose. In order to carry out this function, the second four-way valve 28" is switched so that the fifth connecting port 281" is connected to the eighth connecting port 284" while the sixth connecting port 282" is connected to the seventh connecting port 283". The refrigerant leaving the compressor unit 24" is guided to flow through the first connecting port 271", the second connecting port 272", the fifth connecting port 281" and the eighth connecting port 284", and finally reaches the outdoor heat exchanging unit 29" for releasing heat to the surrounding environment (i.e. outdoor space). The refrigerant leaving the outdoor heat exchanging unit 29" is guided to flow into the first indoor heat exchanging unit 11" through an outdoor unidirectional valve 201", an outdoor filter unit 25" and an outdoor expansion valve 26". The refrigerant then leaves the first indoor heat exchanging unit 11" and passes through fourth connecting port 274", the third connecting port 273", and finally back to the compressor unit 24".

Referring to FIG. 22 and FIG. 29 to FIG. 31 of the drawings, the water cooling unit 22" further comprises a water level sensor 290" provided in the water tank 213" for monitoring the water level in the water tank 213". The outdoor unit 20" further comprises a control module 291" electrically connected to the water level sensor 290" and the first four-way valve 27" and the second four-way valve 28". The control module 291" comprises a switching circuitry 2911" connected to the first four-way valve 27", the second four-way valve 28", and the pumping device 221". Specifically, the switching circuitry 2911" is normally switched in such a manner that the pumping device 221" is electrically powered to pump the cooling water from the water tank 213" to the top water collection basin 222" (position 2 in FIG. 30). When the water-cooled split air conditioning system acts as an air conditioner (i.e. extracting heat from the indoor space), the pumping device 221" operates normally. When the water level sensor 290" detects that the water level in the water tank 213" falls below a predetermined threshold, the switching circuitry 2911" is activated to switch to position 1 as shown in FIG. 29. The pumping device 21" is turned off and the second four-way valve 28" is activated to connect the fifth connecting port 281" to the eighth connecting port 284", and to connect the sixth connecting port 282" to the seventh connecting port 283".

The effect of this change in electrical connections results in a change in the refrigerant cycle. Heated refrigerant or refrigerant steam exits the compressor unit 24" through the compressor outlet 242", and flows into the outdoor heat exchanging unit 29" through the passage of the first connecting port 271" and the second connecting port 272" of the first four-way valve 27", and the fifth port 281" and the eighth port 284" of the second four-way valve 28". The refrigerant perform heat exchange in the outdoor heat exchanging unit 29" and extract heat to the ambient air without using any cooling water or passing through the cooling water unit 22". The refrigerant leaves the outdoor heat exchanging unit 29" and is guided to flow into the first indoor heat exchanging unit 11" through a predetermined number of the outdoor unidirectional valve 201", the outdoor filter unit 25", and the outdoor expansion valve 26". The refrigerant absorbs heat in the first indoor heat exchanging unit 11". The refrigerant leaving the first indoor heat exchanging unit 11" is guided to flow back to the compressor unit 24" through the fourth connecting port 274" and the third connecting port 273" of the first four-way valve 27".

It is important to mention that with the provision of the control module 291", the refrigerant may be changed from a water-cooled system to an air-cooled system as in traditional split air conditioning system. This happens when the water level in the water tank 213" falls below a predetermined threshold. Residual refrigerant in the water cooling unit 22" is guided to exit the water cooling unit 22" and enter the main system through the passage of, sequentially, the fluid inlet 2311", the sixth connecting port 282", the seventh connecting port 283" and the compressor inlet 241".

Figure 30:
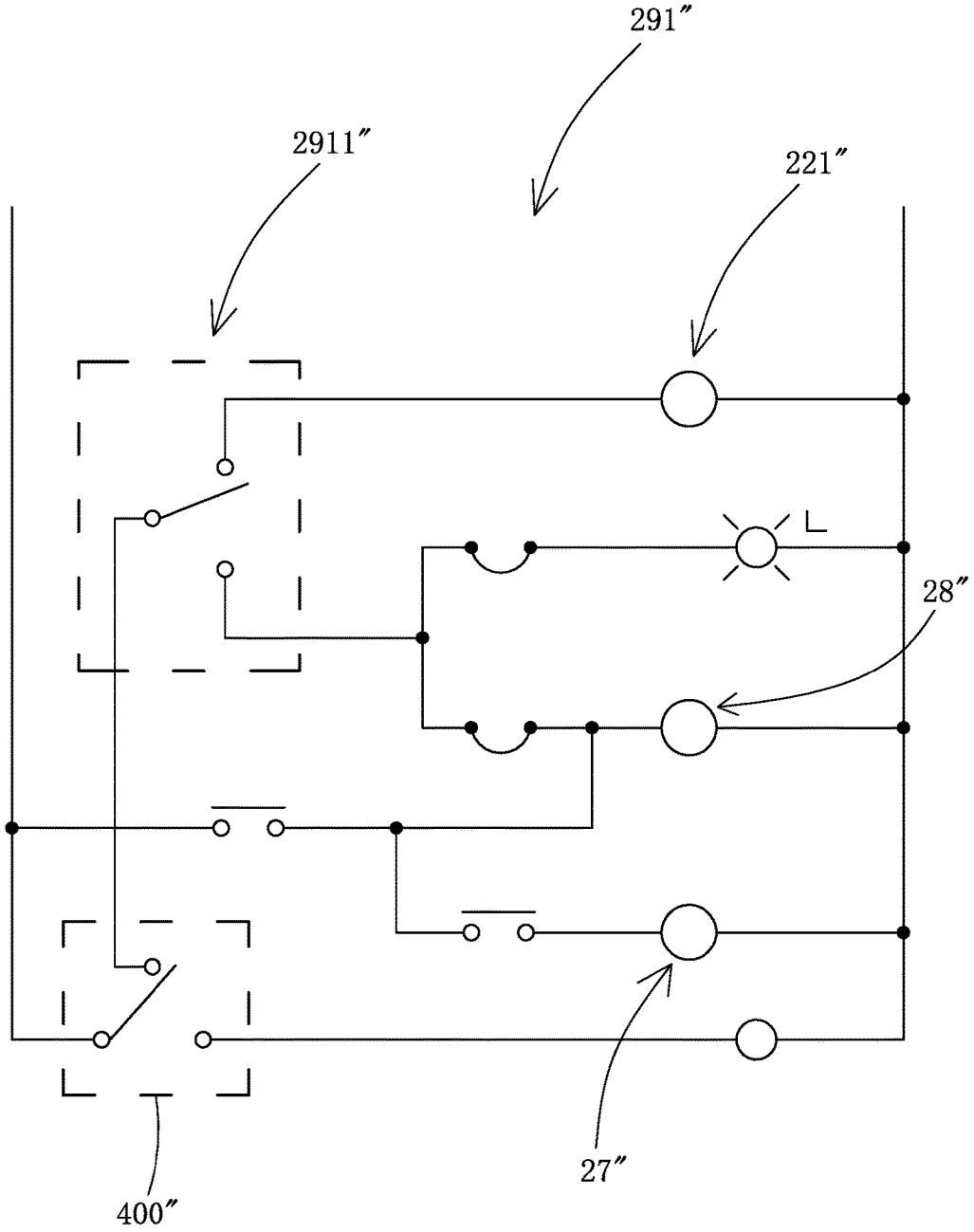
FIG. 30 is schematic diagram of a control module of the water-cooled split air conditioning system according to the first preferred embodiment of the present invention.

When additional cooling water is added in the water tank 213" so that the water level therein is again above the predetermined threshold, the switching circuitry 2911" is activated to switch back to position 2 shown in FIG. 30. When the switching circuitry 2911" is switched back to its original position, the refrigerant restores to its original path as described above (notably passing through the water cooling unit 22"). In other words, the refrigerant is switched from an air-cooled system back to a water cooled system. Residual refrigerant in the outdoor heat exchanging unit 29" is guided to the outdoor heat exchanging unit 29" and go back to the main system through the passage of, sequentially, the eighth connecting port 284", the seventh connecting port 283" and the compressor inlet 241". A switch 400" is provided to switch between operating as an air conditioner or as a heat pump.

Figure 31:
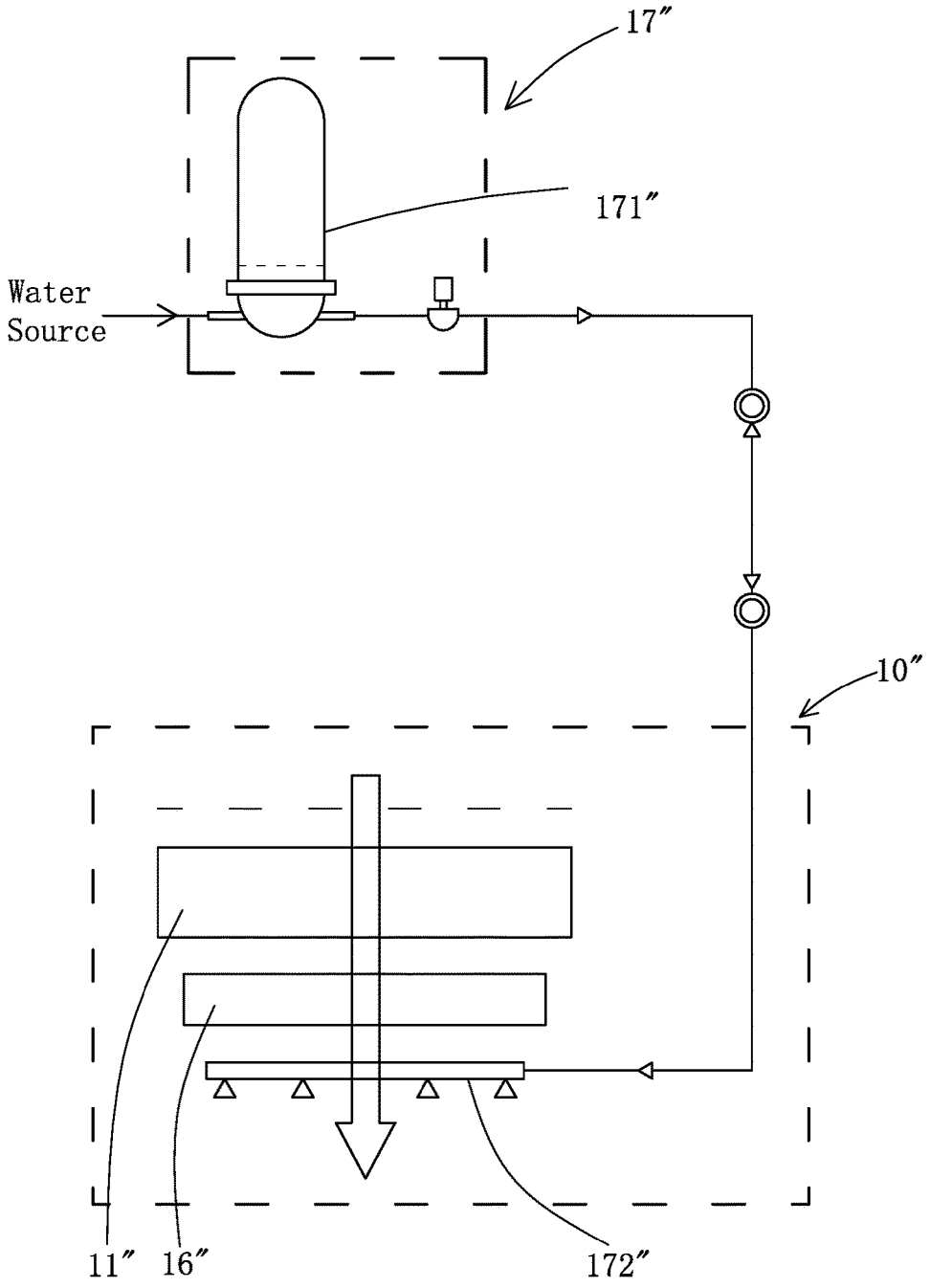
FIG. 31 is a schematic diagram of a humidifying device of the water-cooled split air conditioning system according to the first preferred embodiment of the present invention.

Referring to FIG. 29 and FIG. 31 of the drawings, the humidifying device 17" comprises a water filter 171" connected to a water source, and a spraying device 172" connected to the water filter 171" through an outdoor expansion valve 26" for spraying water in the indoor space. The spraying device 172" is positioned on the outdoor housing 21" in such a manner that the air is drawn to sequentially pass through the first indoor heat exchanging unit 11" and the second indoor heat exchanging unit 16", while the spraying device 172" is arranged to spray a predetermined amount of water to the outgoing air coming from the air outlet 212".

Finally, it is important to highlight some of the distinctive features of the above described invention. First the water cooling unit 22 (22") is capable of reducing temperature of the refrigerant. It is estimated that the temperature of the refrigerant circulating in the present invention may be cooled as much as 10° C. to 14° C. more as compared to conventional water-cooled system.

The present invention, while illustrated and described in terms of a preferred embodiment and several alternatives, is not limited to the particular description contained in this specification. Additional alternative or equivalent components could also be used to practice the present invention.

What is claimed is:

1. A water-cooled split air conditioning system, comprising:

an indoor unit which is arranged to be positioned in an indoor environment, and comprises at least one indoor fan coil unit which comprises an indoor heat exchanging unit;

an outdoor unit which is arranged to be positioned in an outdoor environment, and comprises:

an outdoor housing having an air inlet, an air outlet, and a water tank for storing a predetermined amount of cooling water; and a water cooling unit, which comprises:

a pumping device provided in said water tank for pumping said cooling water;

a top water collection basin for collecting said cooling water from said pumping device, said top water collection basin having at least one peripheral sidewall and a bottom wall to define a storing cavity between said peripheral sidewall and said bottom wall, said bottom wall having a plurality of passage holes;

a fill material unit provided underneath said top water collection basin, wherein said cooling water collected in said storage cavity of said top water collection basin is arranged to flow through said fill material unit through said passage holes;

a bottom water collection basin provided underneath said fill material unit, said cooling water form said fill material unit being arranged to be collected in said bottom water collection basin; and at least one heat exchanging pipe provided in said bottom water collection basin and immersed in said cooling water, said cooling water collected in said bottom water collection tank being arranged to be guided to flow back into said top water collection basin, a predetermined amount of refrigerant being arranged to flow through said heat exchanging pipe in such a manner that said refrigerant is arranged to perform highly efficient heat exchanging process with said cooling water for lowering a temperature of said refrigerant, a predetermined amount of air being drawn from said air inlet for performing heat exchange with said cooling water flowing through said fill material unit for lowering a temperature of said cooling water, said air having absorbed said heat from said cooling water being discharged out of said indoor housing through said air outlet; and a plurality of connecting hoses connecting said indoor unit to said outdoor unit for allowing said refrigerant to circulate between said indoor unit and said outdoor unit.

2. The water-cooled split air conditioning system, as recited in claim 1, wherein said outdoor unit further comprises a compressor unit having a compressor inlet connected to said indoor unit, a compressor outlet connected to said fluid inlet of said water cooling unit, at least one outdoor filter unit and at least one outdoor expansion valve both connected to said fluid outlet of said water cooling unit.

3. The water-cooled split air conditioning system, as recited in claim 2, wherein said indoor heat exchanging unit has an evaporator inlet and an evaporator outlet, wherein said indoor fan coil unit further comprising a dehumidifying unit having a dehumidifier inlet connected to said compressor outlet of said compressor unit, and a dehumidifier outlet.

4. The water-cooled split air conditioning system, as recited in claim 3, wherein said indoor fan coil unit further comprises an indoor housing having an indoor air outlet and an indoor air inlet, and an indoor ventilating unit provided in said indoor housing, air being drawn from a space in which said indoor unit is located and arranged to perform heat exchange with said refrigerant flowing through said indoor heat exchanging unit and said dehumidifying unit, in such a manner that said air is first drawn to perform heat exchange with said refrigerant flowing through said indoor heat exchanging unit and then to perform heat exchange with said refrigerant flowing through said dehumidifying unit.

5. The water-cooled split air conditioning system, as recited in claim 4, wherein said indoor fan coil unit further comprises a plurality of temperature sensors provide at said indoor air inlet and said indoor air outlet respectively, and a humidity sensor provided at said indoor air inlet.

6. The water-cooled split air conditioning system, as recited in claim 5, wherein said heat exchanging pipe has a thin oxidation layer formed on an exterior surface and an interior surface thereof, and a thin layer of polytetrafluoroethylene additionally formed on an exterior surface thereof to prevent unwanted substances from attaching on the exterior surface of said heat exchanging pipe.

7. A water-cooled split air conditioning system, comprising:

an indoor unit which is arranged to be positioned in an indoor environment, and comprises at least one indoor fan coil unit comprising an indoor heat exchanging unit;

an outdoor unit which is arranged to be positioned in an outdoor environment, and comprises:

an outdoor housing having an air inlet, an air outlet, and a water tank for storing a predetermined amount of cooling water; and a water cooling unit, which comprises:

a pumping device provided in said water tank for pumping said cooling water;

a top water collection basin for collecting said cooling water from said pumping device, said top water collection basin having at least one peripheral sidewall and a bottom wall to define a storing cavity between said peripheral sidewall and said bottom wall, said bottom wall having a plurality of passage holes;

a water distributor provided in said top water collection basin for evenly distributing water to said top water collection basin, said water distributor comprising a water storage tank having a water distributing sidewall, and contains a plurality of water distributing slots evenly formed on said water distributing sidewall, said water storage tank communicating with said water tube, said cooling water stored in said water storage tank being arranged to pass through said water distributing sidewall to reach said top water collection basin through said water distributing slots;

a fill material unit provided underneath said top water collection basin, wherein said cooling water collected in said storage cavity of said top water collection basin is arranged to flow through said fill material unit through said passage holes;

a bottom water collection basin provided underneath said fill material unit, said cooling water form said fill material unit being arranged to be collected in said bottom water collection basin; and at least one heat exchanging pipe provided in said bottom water collection basin and immersed in said cooling water, said cooling water collected in said bottom water collection tank being arranged to be guided to flow back into said top water collection basin, a predetermined amount of refrigerant being arranged to flow through said heat exchanging pipe in such a manner that said refrigerant is arranged to perform highly efficient heat exchanging process with said cooling water for lowering a temperature of said refrigerant, a predetermined amount of air being drawn from said air inlet for performing heat exchange with said cooling water flowing through said fill material unit for lowering a temperature of said cooling water, said air having absorbed said heat from said cooling water being discharged out of said indoor housing through said air outlet; and a plurality of connecting hoses connecting said indoor unit to said outdoor unit for allowing said refrigerant to circulate between said indoor unit and said outdoor unit.

8. The water-cooled split air conditioning system, as recited in claim 7, wherein said water cooling unit further comprises a plurality of heat exchanging pipes, and a guiding arrangement comprising an inclined guiding member, and first through third vertical guiding member, said first vertical guiding member extending from a distal end of said inclined guiding member, said second vertical guiding member also downwardly extending from said inclined guiding member, said third vertical guiding member upwardly extending from a bottom wall of said bottom water collection basin at a position between said first vertical guiding member and said second vertical guiding member.

9. The water-cooled split air conditioning system, as recited in claim 7, wherein said water cooling unit further comprises a refrigerant guiding system connected to said heat exchanging pipes to divide said heat exchanging pipes into at least two piping groups so as to guide said refrigerant to flow through said piping groups in a predetermined order.

10. The water-cooled split air conditioning system, as recited in claim 8, wherein said water cooling unit further comprises a refrigerant guiding system connected to said heat exchanging pipes to divide said heat exchanging pipes into at least two piping groups so as to guide said refrigerant to flow through said piping groups in a predetermined order.

11. The water-cooled split air conditioning system, as recited in claim 9, wherein said refrigerant guiding system comprises an inlet collection pipe having a fluid inlet and a fluid outlet, a guiding pipe, and at least one divider, each of said heat exchanging pipes having one end connected to said inlet collection pipe, and another end connected to said guiding pipe, said divider being provided at least in said inlet collection pipe to divide said heat exchanging pipes into at least two of said piping groups.

12. The water-cooled split air conditioning system, as recited in claim 10, wherein said refrigerant guiding system comprises an inlet collection pipe having a fluid inlet and a fluid outlet, a guiding pipe, and at least one divider, each of said heat exchanging pipes having one end connected to said inlet collection pipe, and another end connected to said guiding pipe, said divider being provided at least in said inlet collection pipe to divide said heat exchanging pipes into at least two of said piping groups.

13. The water-cooled split air conditioning system, as recited in claim 11, wherein said refrigerant guiding system further comprises a plurality of heat exchanging fins extended between each two adjacent heat exchanging pipes for substantially increasing a surface area of heat exchanging process between said heat exchanging pipes and said cooling water, and for reinforcing a structural integrity of said refrigerant guiding system.

14. The water-cooled split air conditioning system, as recited in claim 12, wherein said refrigerant guiding system further comprises a plurality of heat exchanging fins extended between each two adjacent heat exchanging pipes for substantially increasing a surface area of heat exchanging process between said heat exchanging pipes and said cooling water, and for reinforcing a structural integrity of said refrigerant guiding system.

15. The water-cooled split air conditioning system, as recited in claim 7, wherein said heat exchanging pipes comprises a pipe body, a plurality of retention members spacedly formed in said pipe body, and a plurality of first heat exchanging fins extended from an inner surface of said pipe body.

16. The water-cooled split air conditioning system, as recited in claim 13, wherein each of said first heat exchanging pipes comprises a pipe body, a plurality of retention members spacedly formed in said pipe body, and a plurality of first heat exchanging fins extended from an inner surface of said pipe body.

17. The water-cooled split air conditioning system, as recited in claim 14, wherein each of said first heat exchanging pipes comprises a pipe body, a plurality of retention members spacedly formed in said pipe body, and a plurality of first heat exchanging fins extended from an inner surface of said pipe body.

18. The water-cooled split air conditioning system, as recited in claim 15, wherein each of said pipe bodies has two curved side portions and a substantially flat mid portion extending between said two curved side portions to form a rectangular cross sectional shape at said mid portion and two semicircular cross sectional shapes at two curved side portions of said corresponding heat exchanging pipe.

19. The water-cooled split air conditioning system, as recited in claim 16, wherein each of said pipe bodies has two curved side portions and a substantially flat mid portion extending between said two curved side portions to form a rectangular cross sectional shape at said mid portion and two semicircular cross sectional shapes at two curved side portions of said corresponding heat exchanging pipe.

20. The water-cooled split air conditioning system, as recited in claim 17, wherein each of said pipe bodies has two curved side portions and a substantially flat mid portion extending between said two curved side portions to form a rectangular cross sectional shape at said mid portion and two semicircular cross sectional shapes at two curved side portions of said corresponding heat exchanging pipe.

21. The water-cooled split air conditioning system, as recited in claim 7, wherein said outdoor unit further comprises a fan unit provided in said outdoor housing and is positioned at one side of said fill material unit for drawing ambient air to flow between said air inlet and said air outlet.

22. The water-cooled split air conditioning system, as recited in claim 20, wherein said outdoor unit further comprises a fan unit provided in said outdoor housing and is positioned at one side of said fill material unit for drawing ambient air to flow between said air inlet and said air outlet.

23. The water-cooled split air conditioning system, as recited in claim 21, wherein said outdoor unit further comprises a compressor unit having a compressor inlet connected to said indoor unit, a compressor outlet connected to said fluid inlet of said water cooling unit, at least one outdoor filter unit and at least one outdoor expansion valve both connected to said fluid outlet of said water cooling unit.

24. The water-cooled split air conditioning system, as recited in claim 22, wherein said outdoor unit further comprises a compressor unit having a compressor inlet connected to said indoor unit, a compressor outlet connected to said fluid inlet of said water cooling unit, at least one outdoor filter unit and at least one outdoor expansion valve both connected to said fluid outlet of said water cooling unit.

25. The water-cooled split air conditioning system, as recited in claim 23, wherein said indoor heat exchanging unit has an evaporator inlet and an evaporator outlet, wherein said indoor fan coil unit further comprising a dehumidifying unit having a dehumidifier inlet connected to said compressor outlet of said compressor unit, and a dehumidifier outlet.

26. The water-cooled split air conditioning system, as recited in claim 24, wherein said indoor heat exchanging unit has an evaporator inlet and an evaporator outlet, wherein said indoor fan coil unit further comprising a dehumidifying unit having a dehumidifier inlet connected to said compressor outlet of said compressor unit, and a dehumidifier outlet.

27. The water-cooled split air conditioning system, as recited in claim 25, wherein said indoor fan coil unit further comprises an indoor housing having an indoor air outlet and an indoor air inlet, and an indoor ventilating unit provided in said indoor housing, air being drawn from a space in which said indoor unit is located and arranged to perform heat exchange with said refrigerant flowing through said indoor heat exchanging unit and said dehumidifying unit, in such a manner that said air is first drawn to perform heat exchange with said refrigerant flowing through said indoor heat exchanging unit and then to perform heat exchange with said refrigerant flowing through said dehumidifying unit.

28. The water-cooled split air conditioning system, as recited in claim 26, wherein said indoor fan coil unit further comprises an indoor housing having an indoor air outlet and an indoor air inlet, and an indoor ventilating unit provided in said indoor housing, air being drawn from a space in which said indoor unit is located and arranged to perform heat exchange with said refrigerant flowing through said indoor heat exchanging unit and said dehumidifying unit, in such a manner that said air is first drawn to perform heat exchange with said refrigerant flowing through said indoor heat exchanging unit and then to perform heat exchange with said refrigerant flowing through said dehumidifying unit.

29. The water-cooled split air conditioning system, as recited in claim 18, wherein said heat exchanging pipe has a thin oxidation layer formed on an exterior surface and an interior surface thereof, and a thin layer of polytetrafluoroethylene additionally formed on an exterior surface thereof to prevent unwanted substances from attaching on the exterior surface of said heat exchanging pipe.

30. The water-cooled split air conditioning system, as recited in claim 19, wherein said heat exchanging pipe has a thin oxidation layer formed on an exterior surface and an interior surface thereof, and a thin layer of polytetrafluoroethylene additionally formed on an exterior surface thereof to prevent unwanted substances from attaching on the exterior surface of said heat exchanging pipe.

31. The water-cooled split air conditioning system, as recited in claim 20, wherein said heat exchanging pipe has a thin oxidation layer formed on an exterior surface and an interior surface thereof, and a thin layer of polytetrafluoroethylene additionally formed on an exterior surface thereof to prevent unwanted substances from attaching on the exterior surface of said heat exchanging pipe.

* * * * *